US011098992B2

(12) United States Patent
Burrow

(10) Patent No.: US 11,098,992 B2
(45) **Date of Patent: *Aug. 24, 2021**

(54) METHOD OF MAKING POLYMER AMMUNITION CARTRIDGE HAVING A TWO-PIECE PRIMER INSERT

(71) Applicant: True Velocity IP Holdings, LLC, Garland, TX (US)

(72) Inventor: Lonnie Burrow, Carrollton, TX (US)

(73) Assignee: True Velocity IP Holdings, LLC, Garland, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/377,777

(22) Filed: Apr. 8, 2019

(65) Prior Publication Data

US 2019/0242682 A1 Aug. 8, 2019

Related U.S. Application Data

(63) Continuation of application No. 15/959,657, filed on Apr. 23, 2018, now Pat. No. 10,302,403, which is a continuation of application No. 15/801,837, filed on Nov. 2, 2017, now Pat. No. 9,976,840, which is a continuation of application No. 15/064,807, filed on Mar. 9, 2016, now Pat. No. 9,835,427.

(51) Int. Cl.

| | |
|---|---|
| ***F42B 5/30*** | (2006.01) |
| ***F42B 5/307*** | (2006.01) |
| ***F42B 5/313*** | (2006.01) |
| *F42C 19/08* | (2006.01) |

(52) U.S. Cl.

CPC ..... *F42B 5/307* (2013.01); *F42B 5/30* (2013.01); *F42B 5/313* (2013.01); *F42C 19/083* (2013.01)

(58) Field of Classification Search

CPC .. F42B 5/297; F42B 5/30; F42B 5/307; F42B 5/36

USPC ..... 102/467, 469, 466, 470

See application file for complete search history.

(56) References Cited

U.S. PATENT DOCUMENTS 62,283 A * 2/1867 Milbank ..... F42B 5/285 102/470
99,528 A * 2/1870 Boyd ..... F42B 5/26 102/469

(Continued)

FOREIGN PATENT DOCUMENTS

CA 2813634 A1 4/2012
CN 102901403 B 6/2014

(Continued)

OTHER PUBLICATIONS

AccurateShooter.com Daily Bulletin "New PolyCase Ammunition and Injection-Molded Bullets" Jan. 11, 2015.

(Continued)

*Primary Examiner* — Derrick R Morgan
(74) *Attorney, Agent, or Firm* — Singleton Law, PLLC; Chainey P. Singleton

(57) ABSTRACT

The present invention provides ammunition cartridge having a two piece primer insert with a flange, a polymeric middle body extending from the primer insert to a cylindrical middle body coupling region, and a polymeric projectile end having a projectile aperture mated to the polymeric middle body.

14 Claims, 9 Drawing Sheets

(56) References Cited

U.S. PATENT DOCUMENTS 113,634 A * 4/1871 Crispin ..... F42B 5/26 102/469
130,679 A * 8/1872 Whitmore ..... F42B 5/36 102/470
159,665 A * 2/1875 Gauthey ..... F42B 5/26 102/469
169,807 A * 11/1875 Hart ..... F42B 5/26 102/469
207,248 A 8/1878 Bush et al.
462,611 A * 11/1891 Ambjorn Comte de Sparre ..... F42B 5/26 102/469
475,008 A 5/1892 Bush
498,856 A * 6/1893 Overbaugh ..... F42B 5/26 102/469
498,857 A * 6/1893 Overbaugh ..... F42B 5/26 102/469
640,856 A * 1/1900 Bailey ..... F42B 5/36 102/470
662,137 A * 11/1900 Tellerson ..... F42B 5/26 102/469
676,000 A * 6/1901 Henneberg ..... F42B 5/36 102/470
743,242 A 11/1903 Bush
865,853 A * 9/1907 Bailey ..... F42B 5/26 102/469
865,979 A * 9/1907 Bailey ..... F42B 5/26 102/469
869,046 A * 10/1907 Bailey ..... F42B 5/26 102/469
905,358 A 12/1908 Peters
933,030 A * 8/1909 Funk ..... F42B 5/36 102/470
957,171 A * 5/1910 Loeb ..... F42B 7/04 102/469
963,911 A * 7/1910 Loeble ..... F42B 5/36 102/470
980,351 A * 1/1911 Sherman ..... F42B 5/26 102/469
1,060,817 A * 5/1913 Clyne ..... F42B 5/26 102/469
1,060,818 A 5/1913 Clyne
1,064,907 A 6/1913 Hoagland
1,187,464 A 6/1916 Offutt
1,936,905 A 11/1933 Gaidos
1,940,657 A 12/1933 Woodford
2,294,822 A * 9/1942 Albree ..... F42B 5/285 102/469
2,465,962 A 3/1949 Allen et al.
2,654,319 A 10/1953 Roske
2,823,611 A * 2/1958 Thayer ..... F42B 5/285 102/469
2,862,446 A 12/1958 Lars
2,918,868 A 12/1959 Lars
2,936,709 A 5/1960 Seavey
2,953,990 A * 9/1960 Miller ..... F42B 7/06 102/449
2,972,947 A 2/1961 Fitzsimmons et al.
3,034,433 A 5/1962 Karl
3,099,958 A * 8/1963 Daubenspeck ..... F42B 5/307 102/449
3,157,121 A * 11/1964 Daubenspeck ..... F42B 7/06 102/466
3,159,701 A 12/1964 Herter
3,170,401 A * 2/1965 Johnson ..... F42B 5/307 102/467
3,171,350 A 3/1965 Metcalf et al.
3,242,789 A 3/1966 Woodring
3,256,815 A * 6/1966 Davidson ..... F42B 7/04 102/462
3,288,066 A * 11/1966 Stadler ..... F42B 5/38 102/430
3,292,538 A 12/1966 Hans et al.
3,332,352 A 7/1967 Olson et al.
3,444,777 A * 5/1969 Lage ..... F42B 7/08 86/23
3,446,146 A * 5/1969 Heinz ..... F42C 19/083 102/470
3,485,170 A 12/1969 Scanlon
3,485,173 A 12/1969 Morgan
3,491,691 A * 1/1970 Vawter ..... F42B 7/06 102/467
3,565,008 A 2/1971 Gulley et al.
3,590,740 A * 7/1971 Herter ..... F42B 7/08 102/466
3,609,904 A 10/1971 Scanlon
3,614,929 A * 10/1971 Herter et al. ..... F42B 7/06 102/453
3,659,528 A * 5/1972 Santala ..... F42B 5/28 102/468
3,688,699 A * 9/1972 Horn ..... F42B 7/06 102/450
3,690,256 A * 9/1972 Schnitzer ..... F42B 5/307 102/465
3,745,924 A * 7/1973 Scanlon ..... F42B 5/307 102/467
3,749,021 A 7/1973 Burgess
3,756,156 A * 9/1973 Schuster ..... F42B 5/307 102/467
3,765,297 A * 10/1973 Skochko ..... F42B 5/28 89/1.1
3,768,413 A 10/1973 Ramsay
3,797,396 A 3/1974 Reed
3,842,739 A * 10/1974 Scanlon ..... F42B 5/073 102/467
3,866,536 A 2/1975 Greenberg
3,874,294 A * 4/1975 Hale ..... F42B 5/307 102/467
3,955,506 A 5/1976 Luther et al.
3,977,326 A * 8/1976 Anderson ..... F42B 5/307 102/467
3,990,366 A * 11/1976 Scanlon ..... F42B 5/26 102/467
4,005,630 A 2/1977 Patrick
4,007,686 A * 2/1977 Hugonet ..... F42B 7/06 102/467
4,020,763 A * 5/1977 Iruretagoyena ..... F42B 5/313 102/469
4,132,173 A * 1/1979 Amuchastegui ..... F42B 5/36 102/470
4,147,107 A * 4/1979 Ringdal ..... F42B 5/307 102/467
4,157,684 A 6/1979 Clausser
4,173,186 A 11/1979 Dunham
4,179,992 A * 12/1979 Ramnarace ..... F42C 19/10 102/470
4,187,271 A * 2/1980 Rolston ..... B29C 70/443 264/258
4,228,724 A 10/1980 Leich
4,276,830 A 7/1981 Alice
4,353,304 A * 10/1982 Hubsch ..... F42C 19/12 102/470
4,475,435 A 10/1984 Mantel
4,483,251 A 11/1984 Spalding
4,598,445 A * 7/1986 O'Connor ..... F42B 5/285 86/19.6
4,614,157 A * 9/1986 Grelle ..... F42B 5/313 102/466
4,679,505 A * 7/1987 Reed ..... F42B 7/04 102/449
4,718,348 A 1/1988 Ferrigno
4,719,859 A 1/1988 Ballreich et al.
4,726,296 A * 2/1988 Leshner ..... F42B 5/307 102/467
4,763,576 A 8/1988 Kass et al.
4,867,065 A 9/1989 Kaltmann et al.
4,958,568 A * 9/1990 Buenemann ..... F42B 5/307 102/466
4,970,959 A 11/1990 Bilsbury et al.

(56) References Cited

U.S. PATENT DOCUMENTS 5,021,206 A * 6/1991 Stoops ..... B29C 55/22 102/466
5,033,386 A * 7/1991 Vatsvog ..... F42B 5/307 102/430
5,063,853 A * 11/1991 Bilgeri ..... B82Y 15/00 102/444
5,090,327 A * 2/1992 Bilgeri ..... F42C 19/0826 102/430
5,127,331 A 7/1992 Stoops
5,151,555 A 9/1992 Vatsvog
5,165,040 A 11/1992 Andersson et al.
5,237,930 A 8/1993 Belanger et al.
5,247,888 A * 9/1993 Conil ..... F42B 5/18 102/431
5,259,288 A * 11/1993 Vatsvog ..... F42B 5/307 102/430
5,265,540 A * 11/1993 Ducros ..... F42B 5/045 102/434
D345,676 S 4/1994 Biffle
5,433,148 A * 7/1995 Barratault ..... F42B 5/045 102/430
5,535,495 A 7/1996 Gutowski
5,563,365 A 10/1996 Dineen et al.
5,616,642 A 4/1997 West et al.
D380,650 S 7/1997 Norris
5,679,920 A 10/1997 Hallis et al.
5,758,445 A 6/1998 Casull
5,770,815 A 6/1998 Watson
5,798,478 A 8/1998 Beal
5,950,063 A 9/1999 Hens et al.
5,961,200 A 10/1999 Friis
5,969,288 A * 10/1999 Baud ..... F42B 5/313 102/466
5,979,331 A * 11/1999 Casull ..... F42B 5/26 102/464
6,004,682 A 12/1999 Rackovan et al.
6,048,379 A 4/2000 Bray et al.
6,070,532 A 6/2000 Halverson
D435,626 S 12/2000 Benini
6,257,148 B1 * 7/2001 Toivonen ..... F41F 3/052 102/439
6,257,149 B1 7/2001 Cesaroni
D447,209 S 8/2001 Benini
6,272,993 B1 8/2001 Cook et al.
6,283,035 B1 9/2001 Olson et al.
6,357,357 B1 3/2002 Glasser
D455,052 S 4/2002 Gullickson et al.
D455,320 S 4/2002 Edelstein
6,375,971 B1 4/2002 Hansen
6,408,764 B1 * 6/2002 Heitmann ..... F42B 5/18 102/431
6,450,099 B1 * 9/2002 Desgland ..... F42B 5/18 102/431
6,460,464 B1 10/2002 Attarwala
6,523,476 B1 2/2003 Riess et al.
6,644,204 B2 * 11/2003 Pierrot ..... F42B 5/08 102/430
6,649,095 B2 11/2003 Buja
6,672,219 B2 1/2004 Mackerell et al.
6,708,621 B1 * 3/2004 Forichon-Chaumet ..... F42B 5/181 102/202
6,752,084 B1 6/2004 Husseini et al.
6,796,243 B2 * 9/2004 Schmees ..... F42B 5/08 102/431
6,810,816 B2 11/2004 Rennard
6,840,149 B2 1/2005 Beal
6,845,716 B2 1/2005 Husseini et al.
7,000,547 B2 2/2006 Amick
7,014,284 B2 3/2006 Morton et al.
7,032,492 B2 4/2006 Meshirer
7,056,091 B2 6/2006 Powers
7,059,234 B2 * 6/2006 Husseini ..... F42B 5/02 86/55
7,165,496 B2 1/2007 Reynolds
D540,710 S 4/2007 Charrin
7,204,191 B2 4/2007 Wiley et al.
7,213,519 B2 * 5/2007 Wiley ..... B29C 65/02 102/464
7,231,519 B2 6/2007 Joseph et al.
7,232,473 B2 6/2007 Elliott
7,299,750 B2 11/2007 Schikora et al.
7,353,756 B2 4/2008 Leasure
7,380,505 B1 6/2008 Shiery
7,383,776 B2 6/2008 Amick
7,392,746 B2 7/2008 Hansen
7,441,504 B2 10/2008 Husseini et al.
D583,927 S 12/2008 Benner
7,458,322 B2 12/2008 Reynolds et al.
7,461,597 B2 12/2008 Brunn
7,568,417 B1 8/2009 Lee
7,585,166 B2 9/2009 Buja
7,610,858 B2 11/2009 Chung
7,750,091 B2 7/2010 Maljkovic et al.
D626,619 S 11/2010 Gogol et al.
7,841,279 B2 11/2010 Reynolds et al.
D631,699 S 2/2011 Moreau
D633,166 S 2/2011 Richardson et al.
7,930,977 B2 4/2011 Klein
8,007,370 B2 8/2011 Hirsch et al.
8,056,232 B2 11/2011 Patel et al.
8,156,870 B2 4/2012 South
8,186,273 B2 5/2012 Trivette
8,201,867 B2 6/2012 Thomeczek
8,206,522 B2 6/2012 Sandstrom et al.
8,240,252 B2 8/2012 Maljkovic et al.
D675,882 S 2/2013 Crockett
8,393,273 B2 3/2013 Weeks et al.
8,408,137 B2 4/2013 Battaglia
D683,419 S 5/2013 Rebar
8,443,729 B2 5/2013 Mittelstaedt
8,443,730 B2 * 5/2013 Padgett ..... F42B 5/313 102/466
8,511,233 B2 8/2013 Nilsson
D689,975 S 9/2013 Carlson et al.
8,522,684 B2 9/2013 Davies et al.
8,540,828 B2 9/2013 Busky et al.
8,561,543 B2 * 10/2013 Burrow ..... F42B 5/307 102/467
8,573,126 B2 * 11/2013 Klein ..... F42B 5/36 102/430
8,641,842 B2 2/2014 Hafner et al.
8,689,696 B1 4/2014 Seeman et al.
8,763,535 B2 7/2014 Padgett
8,790,455 B2 7/2014 Borissov et al.
8,807,008 B2 8/2014 Padgett et al.
8,813,650 B2 8/2014 Maljkovic et al.
D715,888 S 10/2014 Padgett
8,850,985 B2 10/2014 Maljkovic et al.
8,857,343 B2 10/2014 Marx
8,869,702 B2 10/2014 Padgett
D717,909 S 11/2014 Thrift et al.
8,875,633 B2 11/2014 Padgett
8,893,621 B1 11/2014 Escobar
8,978,559 B2 3/2015 Davies et al.
9,003,973 B1 4/2015 Padgett
9,032,855 B1 5/2015 Foren et al.
9,091,516 B2 * 7/2015 Davies ..... F42B 5/307
9,103,641 B2 8/2015 Nielson et al.
9,157,709 B2 10/2015 Nuetzman et al.
9,170,080 B2 10/2015 Poore et al.
9,182,204 B2 11/2015 Maljkovic et al.
9,188,412 B2 11/2015 Maljkovic et al.
9,200,157 B2 12/2015 El-Hibri et al.
9,200,880 B1 * 12/2015 Foren ..... F42B 33/02
9,212,876 B1 12/2015 Kostka et al.
9,212,879 B2 12/2015 Whitworth
9,213,175 B2 12/2015 Arnold
9,254,503 B2 2/2016 Ward
9,255,775 B1 2/2016 Rubin
D752,397 S 3/2016 Seiders et al.

(56) References Cited

U.S. PATENT DOCUMENTS

D754,223 S 4/2016 Pederson et al.
9,329,004 B2 * 5/2016 Pace ..... F42B 5/285
9,335,137 B2 5/2016 Maljkovic et al.
9,337,278 B1 5/2016 Gu et al.
9,347,457 B2 5/2016 Ahrens et al.
9,366,512 B2 6/2016 Burczynski et al.
9,377,278 B2 6/2016 Rubin
9,389,052 B2 7/2016 Conroy et al.
9,395,165 B2 7/2016 Maljkovic et al.
D764,624 S 8/2016 Masinelli
D765,214 S 8/2016 Padgett
9,429,407 B2 8/2016 Burrow
9,441,930 B2 * 9/2016 Burrow ..... F42B 5/307
9,453,714 B2 9/2016 Bosarge et al.
D773,009 S 11/2016 Bowers
9,500,453 B2 11/2016 Schluckebier et al.
9,506,735 B1 * 11/2016 Burrow ..... F42C 19/083
D774,824 S 12/2016 Gallagher
9,513,096 B2 12/2016 Burrow
9,518,810 B1 * 12/2016 Burrow ..... F42C 19/083
9,523,563 B1 * 12/2016 Burrow ..... F42C 19/083
9,528,799 B2 12/2016 Maljkovic
9,546,849 B2 1/2017 Burrow
9,551,557 B1 * 1/2017 Burrow ..... F42C 19/083
D778,391 S 2/2017 Burrow
D778,393 S 2/2017 Burrow
D778,394 S 2/2017 Burrow
D778,395 S 2/2017 Burrow
D779,021 S 2/2017 Burrow
D779,024 S 2/2017 Burrow
D780,283 S 2/2017 Burrow
D781,393 S * 3/2017 Burrow ..... D22/115
9,587,918 B1 3/2017 Burrow
9,599,443 B2 3/2017 Padgett et al.
9,625,241 B2 4/2017 Neugebauer
9,631,907 B2 * 4/2017 Burrow ..... F42B 5/307
9,644,930 B1 5/2017 Burrow
9,658,042 B2 5/2017 Emary
9,683,818 B2 6/2017 Lemke et al.
D792,200 S 7/2017 Baiz et al.
9,709,368 B2 7/2017 Mahnke
D797,880 S 9/2017 Seecamp
9,759,554 B2 9/2017 Ng et al.
D800,244 S 10/2017 Burczynski et al.
D800,245 S 10/2017 Burczynski et al.
D800,246 S 10/2017 Burczynski et al.
9,784,667 B2 10/2017 Lukay et al.
9,835,423 B2 12/2017 Burrow
9,835,427 B2 * 12/2017 Burrow ..... F42C 19/083
9,857,151 B2 1/2018 Dionne et al.
9,869,536 B2 * 1/2018 Burrow ..... F42B 33/001
9,879,954 B2 1/2018 Hajjar
9,885,551 B2 2/2018 Burrow
D813,975 S 3/2018 White
9,921,040 B2 3/2018 Rubin
9,927,219 B2 3/2018 Burrow
9,933,241 B2 4/2018 Burrow
9,939,236 B2 4/2018 Drobockyi et al.
9,964,388 B1 * 5/2018 Burrow ..... F42C 19/083
D821,536 S 6/2018 Christiansen et al.
9,989,339 B2 6/2018 Riess
10,041,770 B2 8/2018 Burrow
10,041,771 B1 8/2018 Burrow
10,041,776 B1 8/2018 Burrow
10,041,777 B1 8/2018 Burrow
10,048,049 B2 8/2018 Burrow
10,048,050 B1 8/2018 Burrow
10,048,052 B2 8/2018 Burrow
10,054,413 B1 8/2018 Burrow
D828,483 S 9/2018 Burrow
10,081,057 B2 9/2018 Burrow
D832,037 S 10/2018 Gallagher
10,101,140 B2 10/2018 Burrow
10,124,343 B2 11/2018 Tsai
10,145,662 B2 12/2018 Burrow
10,190,857 B2 1/2019 Burrow
10,234,249 B2 3/2019 Burrow
10,234,253 B2 3/2019 Burrow
10,240,905 B2 3/2019 Burrow
10,254,096 B2 4/2019 Burrow
10,260,847 B2 4/2019 Viggiano et al.
D849,181 S 5/2019 Burrow
10,302,403 B2 * 5/2019 Burrow ..... F42C 19/083
10,302,404 B2 5/2019 Burrow
10,323,918 B2 6/2019 Menefee, III
10,330,451 B2 6/2019 Burrow
10,345,088 B2 7/2019 Burrow
10,352,664 B2 7/2019 Burrow
10,352,670 B2 7/2019 Burrow
10,359,262 B2 7/2019 Burrow
10,365,074 B2 7/2019 Burrow
D861,118 S 9/2019 Burrow
D861,119 S 9/2019 Burrow
10,408,582 B2 9/2019 Burrow
10,408,592 B2 9/2019 Boss et al.
10,415,943 B2 9/2019 Burrow
10,429,156 B2 10/2019 Burrow
10,458,762 B2 10/2019 Burrow
10,466,020 B2 11/2019 Burrow
10,466,021 B2 11/2019 Burrow
10,480,911 B2 11/2019 Burrow
10,480,912 B2 11/2019 Burrow
10,480,915 B2 11/2019 Burrow et al.
10,488,165 B2 11/2019 Burrow
10,533,830 B2 1/2020 Burrow et al.
10,571,228 B2 2/2020 Burrow
10,571,229 B2 2/2020 Burrow
10,571,230 B2 2/2020 Burrow
10,571,231 B2 2/2020 Burrow
10,578,409 B2 3/2020 Burrow
10,591,260 B2 3/2020 Burrow et al.
D882,019 S 4/2020 Burrow et al.
D882,020 S 4/2020 Burrow et al.
D882,021 S 4/2020 Burrow et al.
D882,022 S 4/2020 Burrow et al.
D882,023 S 4/2020 Burrow et al.
D882,024 S 4/2020 Burrow et al.
D882,025 S 4/2020 Burrow et al.
D882,026 S 4/2020 Burrow et al.
D882,027 S 4/2020 Burrow et al.
D882,028 S 4/2020 Burrow et al.
D882,029 S 4/2020 Burrow et al.
D882,030 S 4/2020 Burrow et al.
D882,031 S 4/2020 Burrow et al.
D882,032 S 4/2020 Burrow et al.
D882,033 S 4/2020 Burrow et al.
D882,720 S 4/2020 Burrow et al.
D882,721 S 4/2020 Burrow et al.
D882,722 S 4/2020 Burrow et al.
D882,723 S 4/2020 Burrow et al.
D882,724 S 4/2020 Burrow et al.
10,612,896 B2 4/2020 Burrow
10,612,897 B2 4/2020 Burrow et al.
D884,115 S 5/2020 Burrow et al.
D886,231 S 6/2020 Burrow et al.
D886,937 S 6/2020 Burrow et al.
10,677,573 B2 6/2020 Burrow et al.
D891,567 S 7/2020 Burrow et al.
D891,568 S 7/2020 Burrow et al.
D891,569 S 7/2020 Burrow et al.
D891,570 S 7/2020 Burrow et al.
10,704,869 B2 7/2020 Burrow et al.
10,704,870 B2 7/2020 Burrow et al.
10,704,871 B2 7/2020 Burrow et al.
10,704,872 B1 7/2020 Burrow et al.
10,704,876 B2 7/2020 Boss et al.
10,704,877 B2 7/2020 Boss et al.
10,704,878 B2 7/2020 Boss et al.
10,704,879 B1 7/2020 Burrow et al.
10,704,880 B1 7/2020 Burrow et al.
D892,258 S 8/2020 Burrow et al.
D893,665 S 8/2020 Burrow et al.
D893,666 S 8/2020 Burrow et al.
D893,667 S 8/2020 Burrow et al.

(56) References Cited

U.S. PATENT DOCUMENTS

D893,668 S 8/2020 Burrow et al.
D894,320 S 8/2020 Burrow et al.
10,731,956 B2 8/2020 Burrow et al.
10,731,957 B1 8/2020 Burrow et al.
10,753,713 B2 8/2020 Burrow
10,760,882 B1 9/2020 Burrow
D903,038 S 11/2020 Burrow et al.
D903,039 S 11/2020 Burrow et al.
10,845,169 B2 11/2020 Burrow
10,852,108 B2 12/2020 Burrow et al.
10,859,352 B2 12/2020 Burrow
10,876,822 B2 12/2020 Burrow et al.
10,948,272 B1 * 3/2021 Drobockyi ..... F42B 5/285
2003/0127011 A1 7/2003 Mackerell et al.
2004/0074412 A1 4/2004 Kightlinger
2004/0200340 A1 * 10/2004 Robinson ..... B22F 3/1241 86/54
2005/0056183 A1 * 3/2005 Meshirer ..... F42B 5/025 102/439
2005/0081704 A1 * 4/2005 Husseini ..... F42B 5/02 86/55
2005/0132922 A1 * 6/2005 Thiesen ..... C06B 23/02 102/469
2005/0257712 A1 11/2005 Husseini et al.
2006/0027125 A1 2/2006 Brunn
2006/0278116 A1 12/2006 Hunt
2006/0283345 A1 12/2006 Feldman et al.
2007/0056343 A1 3/2007 Cremonesi
2007/0181029 A1 8/2007 Mcaninch
2007/0214992 A1 * 9/2007 Dittrich ..... F42B 5/36 102/469
2007/0214993 A1 9/2007 Cerovic et al.
2007/0261587 A1 * 11/2007 Chung ..... F42B 5/313 102/469
2007/0267587 A1 11/2007 Dalluge
2010/0101444 A1 * 4/2010 Schluckebier ..... F42B 7/08 102/448
2010/0212533 A1 * 8/2010 Brunn ..... F42B 4/26 102/502
2010/0234132 A1 9/2010 Hirsch et al.
2010/0258023 A1 * 10/2010 Reynolds ..... F42B 5/36 102/470
2010/0282112 A1 * 11/2010 Battaglia ..... F42B 5/26 102/467
2011/0179965 A1 * 7/2011 Mason ..... F42B 5/307 102/467
2012/0024183 A1 * 2/2012 Klein ..... F42B 5/307 102/467
2012/0111219 A1 * 5/2012 Burrow ..... F42B 5/307 102/467
2012/0180685 A1 7/2012 Se-Hong
2012/0180687 A1 * 7/2012 Padgett ..... F42B 5/313 102/466
2012/0180688 A1 * 7/2012 Padgett ..... F42B 5/313 102/466
2012/0291655 A1 11/2012 Jones
2013/0008335 A1 * 1/2013 Menefee, III ..... F42B 5/03 102/460
2013/0014664 A1 1/2013 Padgett
2013/0076865 A1 3/2013 Tateno et al.
2013/0186294 A1 * 7/2013 Davies ..... F42B 5/307 102/467
2013/0291711 A1 11/2013 Mason
2014/0224144 A1 * 8/2014 Neugebauer ..... F42B 5/285 102/470
2014/0260925 A1 * 9/2014 Beach ..... F42B 33/001 86/28
2014/0261044 A1 9/2014 Seecamp
2014/0311332 A1 10/2014 Carlson et al.
2015/0075400 A1 * 3/2015 Lemke ..... F42B 5/307 102/517
2015/0226220 A1 8/2015 Bevington
2015/0241183 A1 * 8/2015 Padgett ..... F42B 5/025 102/466
2015/0268020 A1 9/2015 Emary
2016/0003585 A1 1/2016 Carpenter et al.
2016/0003589 A1 1/2016 Burrow
2016/0003590 A1 1/2016 Burrow
2016/0003593 A1 1/2016 Burrow
2016/0003594 A1 1/2016 Burrow
2016/0003595 A1 1/2016 Burrow
2016/0003596 A1 1/2016 Burrow
2016/0003597 A1 1/2016 Burrow
2016/0003601 A1 * 1/2016 Burrow ..... F42B 5/307 102/467
2016/0033241 A1 2/2016 Burrow
2016/0102030 A1 4/2016 Coffey et al.
2016/0146585 A1 5/2016 Padgett
2016/0245626 A1 * 8/2016 Drieling ..... F42B 5/295
2016/0265886 A1 * 9/2016 Aldrich ..... F42B 5/30
2016/0349022 A1 12/2016 Burrow
2016/0349023 A1 12/2016 Burrow
2016/0349028 A1 12/2016 Burrow
2016/0356588 A1 12/2016 Burrow
2016/0377399 A1 12/2016 Burrow
2017/0030690 A1 2/2017 Viggiano et al.
2017/0030692 A1 * 2/2017 Drobockyi ..... F42B 5/285
2017/0080498 A1 3/2017 Burrow
2017/0082409 A1 3/2017 Burrow
2017/0082411 A1 3/2017 Burrow
2017/0089673 A1 3/2017 Burrow
2017/0089674 A1 3/2017 Burrow
2017/0089675 A1 3/2017 Burrow
2017/0089679 A1 3/2017 Burrow
2017/0115105 A1 * 4/2017 Burrow ..... F42B 33/001
2017/0153093 A9 * 6/2017 Burrow ..... F42B 5/307
2017/0153099 A9 6/2017 Burrow
2017/0191812 A1 * 7/2017 Padgett ..... F42B 5/313
2017/0199018 A9 * 7/2017 Burrow ..... F42B 5/307
2017/0205217 A9 7/2017 Burrow
2017/0261296 A1 * 9/2017 Burrow ..... F42B 33/001
2017/0261299 A1 * 9/2017 Burrow ..... F42C 19/083
2017/0299352 A9 10/2017 Burrow
2018/0066925 A1 3/2018 Skowron et al.
2018/0106581 A1 4/2018 Rogers
2018/0224252 A1 8/2018 O'Rourke
2018/0224253 A1 8/2018 Burrow
2018/0224256 A1 8/2018 Burrow
2018/0259310 A1 9/2018 Burrow
2018/0292186 A1 10/2018 Padgett et al.
2018/0306558 A1 10/2018 Padgett et al.
2019/0011232 A1 1/2019 Boss et al.
2019/0011233 A1 1/2019 Boss et al.
2019/0011234 A1 1/2019 Boss et al.
2019/0011235 A1 1/2019 Boss et al.
2019/0011236 A1 1/2019 Burrow
2019/0011237 A1 1/2019 Burrow
2019/0011238 A1 1/2019 Burrow
2019/0011239 A1 1/2019 Burrow
2019/0011240 A1 1/2019 Burrow
2019/0011241 A1 1/2019 Burrow
2019/0025019 A1 1/2019 Burrow
2019/0025020 A1 1/2019 Burrow
2019/0025021 A1 1/2019 Burrow
2019/0025022 A1 1/2019 Burrow
2019/0025023 A1 1/2019 Burrow
2019/0025024 A1 1/2019 Burrow
2019/0025025 A1 1/2019 Burrow
2019/0025026 A1 1/2019 Burrow
2019/0025035 A1 1/2019 Burrow
2019/0025036 A1 1/2019 Burrow
2019/0078862 A1 3/2019 Burrow
2019/0106364 A1 4/2019 James
2019/0107375 A1 4/2019 Burrow
2019/0137228 A1 5/2019 Burrow et al.
2019/0137229 A1 5/2019 Burrow et al.
2019/0137230 A1 5/2019 Burrow et al.
2019/0137231 A1 5/2019 Burrow et al.
2019/0137232 A1 5/2019 Burrow et al.
2019/0137233 A1 5/2019 Burrow et al.
2019/0137234 A1 5/2019 Burrow et al.

(56) References Cited

U.S. PATENT DOCUMENTS

| | | | | |
|---|---|---|---|---|
| 2019/0137235 | A1 | 5/2019 | Burrow et al. | |
| 2019/0137236 | A1 | 5/2019 | Burrow et al. | |
| 2019/0137237 | A1 | 5/2019 | Burrow et al. | |
| 2019/0137238 | A1 | 5/2019 | Burrow et al. | |
| 2019/0137239 | A1 | 5/2019 | Burrow et al. | |
| 2019/0137240 | A1 | 5/2019 | Burrow et al. | |
| 2019/0137241 | A1 | 5/2019 | Burrow et al. | |
| 2019/0137242 | A1 | 5/2019 | Burrow et al. | |
| 2019/0137243 | A1 | 5/2019 | Burrow et al. | |
| 2019/0137244 | A1 | 5/2019 | Burrow et al. | |
| 2019/0170488 | A1 | 6/2019 | Burrow | |
| 2019/0204050 | A1 | 7/2019 | Burrow | |
| 2019/0204056 | A1 | 7/2019 | Burrow | |
| 2019/0212117 | A1* | 7/2019 | Burrow | F42B 5/30 |
| 2019/0242679 | A1 | 8/2019 | Viggiano et al. | |
| 2019/0242682 | A1 | 8/2019 | Burrow | |
| 2019/0242683 | A1 | 8/2019 | Burrow | |
| 2019/0249967 | A1 | 8/2019 | Burrow et al. | |
| 2019/0257625 | A1 | 8/2019 | Burrow | |
| 2019/0310058 | A1 | 10/2019 | Burrow | |
| 2019/0310059 | A1 | 10/2019 | Burrow | |
| 2019/0316886 | A1 | 10/2019 | Burrow | |
| 2019/0360788 | A1 | 11/2019 | Burrow | |
| 2019/0376773 | A1 | 12/2019 | Burrow | |
| 2019/0376774 | A1 | 12/2019 | Boss et al. | |
| 2019/0383590 | A1 | 12/2019 | Burrow | |
| 2020/0011645 | A1 | 1/2020 | Burrow et al. | |
| 2020/0011646 | A1 | 1/2020 | Burrow et al. | |
| 2020/0025536 | A1 | 1/2020 | Burrow et al. | |
| 2020/0025537 | A1 | 1/2020 | Burrow et al. | |
| 2020/0033102 | A1 | 1/2020 | Burrow | |
| 2020/0033103 | A1 | 1/2020 | Burrow et al. | |
| 2020/0041239 | A1 | 2/2020 | Burrow | |
| 2020/0049469 | A1 | 2/2020 | Burrow | |
| 2020/0049470 | A1 | 2/2020 | Burrow | |
| 2020/0049471 | A1 | 2/2020 | Burrow | |
| 2020/0049472 | A1 | 2/2020 | Burrow | |
| 2020/0049473 | A1 | 2/2020 | Burrow | |
| 2020/0056872 | A1 | 2/2020 | Burrow | |
| 2020/0109932 | A1 | 4/2020 | Burrow | |
| 2020/0149853 | A1 | 5/2020 | Burrow | |
| 2020/0158483 | A1 | 5/2020 | Burrow | |
| 2020/0200512 | A1 | 6/2020 | Burrow | |
| 2020/0200513 | A1 | 6/2020 | Burrow | |
| 2020/0208948 | A1 | 7/2020 | Burrow | |
| 2020/0208949 | A1 | 7/2020 | Burrow | |
| 2020/0208950 | A1 | 7/2020 | Burrow | |
| 2020/0225009 | A1 | 7/2020 | Burrow | |
| 2020/0248998 | A1 | 8/2020 | Burrow | |
| 2020/0248999 | A1 | 8/2020 | Burrow | |
| 2020/0249000 | A1 | 8/2020 | Burrow | |
| 2020/0256654 | A1 | 8/2020 | Burrow | |
| 2020/0263967 | A1 | 8/2020 | Burrow et al. | |
| 2020/0278183 | A1 | 9/2020 | Burrow et al. | |
| 2020/0292283 | A1 | 9/2020 | Burrow | |
| 2020/0300587 | A1 | 9/2020 | Burrow et al. | |
| 2020/0300592 | A1 | 9/2020 | Overton et al. | |
| 2020/0309490 | A1 | 10/2020 | Burrow et al. | |
| 2020/0309496 | A1 | 10/2020 | Burrow et al. | |
| 2020/0326168 | A1 | 10/2020 | Boss et al. | |
| 2020/0363173 | A1 | 11/2020 | Burrow | |
| 2020/0363179 | A1 | 11/2020 | Overton et al. | |
| 2020/0378734 | A1 | 12/2020 | Burrow | |
| 2020/0393220 | A1 | 12/2020 | Burrow | |
| 2020/0400411 | A9 | 12/2020 | Burrow | |
| 2021/0003373 | A1 | 1/2021 | Burrow | |
| 2021/0041211 | A1* | 2/2021 | Pennell | F42B 35/02 |
| 2021/0108898 | A1* | 4/2021 | Overton | F42B 5/307 |

FOREIGN PATENT DOCUMENTS

| | | | |
|---|---|---|---|
| DE | 16742 | C | 1/1882 |
| EP | 2625486 | A4 | 8/2017 |
| FR | 1412414 | A | 10/1965 |
| GB | 783023 | A | 9/1957 |
| RU | 2172467 | C1 | 8/2001 |
| WO | 0034732 | | 6/2000 |
| WO | 2007014024 | A2 | 2/2007 |
| WO | 2012047615 | A1 | 4/2012 |
| WO | 2012097320 | A1 | 7/2012 |
| WO | 2012097317 | A3 | 11/2012 |
| WO | 2013070250 | A1 | 5/2013 |
| WO | 2013096848 | A1 | 6/2013 |
| WO | 2014062256 | A2 | 4/2014 |
| WO | 2016003817 | A1 | 1/2016 |
| WO | 2019094544 | A1 | 5/2019 |
| WO | 2019160742 | A2 | 8/2019 |

OTHER PUBLICATIONS

International Ammunition Association, Inc. website, published on Apr. 2017, PCP Ammo Variation in U.S. Military Polymer/Metal Cartridge Case R&D, Available on the Internet URL https://forum.cartridgecollectors.org/t/pcp-ammo-variation-in-u-s-military-polyer-metal-cartridge-case-r-d/24400.

International Search Report and Written Opinion for PCTUS201859748 dated Mar. 1, 2019, pp. 1-9.

International Search Report and Written Opinion for PCTUS2019017085 dated Apr. 19, 2019, pp. 1-9.

Korean Intellectual Property Office (ISA), International Search Report and Written Opinion for PCT/US2011/062781 dated Nov. 30, 2012, 16 pp.

Korean Intellectual Property Office (ISA), International Search Report and Written Opinion for PCT/US2015/038061 dated Sep. 21, 2015, 28 pages.

Luck Gunner.com, Review: Polymer Cased Rifle Ammunition from PCP Ammo, Published Jan. 6, 2014, Available on the Internet URL https://www.luckygunner.com/lounge/pcp-ammo-review.

YouTube.com—TFB TV, Published on Jul. 23, 2015, available on Internal URL https://www.youtubecom/watch?v=mCjNkbxHkEE.

International Search Report and Written Opinion in PCT/US2019/040323 dated Sep. 24, 2019, pp. 1-16.

International Search Report and Written Opinion in PCT/US2019/040329 dated Sep. 27, 2019, pp. 1-24.

International Preliminary Report on Patentability and Written Opinion in PCT/US2018/059748 dated May 12, 2020; pp. 1-8.

International Search Report and Written Opinion in PCT/US2020/023273 dated Oct. 7, 2020; pp. 1-11.

IPRP in PCT2019017085 dated Aug. 27, 2020, pp. 1-8.

* cited by examiner

METHOD OF MAKING POLYMER AMMUNITION CARTRIDGE HAVING A TWO-PIECE PRIMER INSERT

CROSS-REFERENCE TO RELATED APPLICATIONS

This application is a Continuation Application of and claims priority based on U.S. patent application Ser. No. 15/959,657, filed Apr. 23, 2018, which claims priority based on U.S. patent application Ser. No. 15/801,837, filed Nov. 2, 2017, now U.S. Pat. No. 9,976,840, which claims priority based on U.S. patent application Ser. No. 15/064,807, filed Mar. 9, 2016, now U.S. Pat. No. 9,835,427, the contents of which is all incorporated by reference herein in their entirety.

TECHNICAL FIELD OF THE INVENTION

The present invention relates in general to the field of ammunition, specifically to polymer ammunition cartridges having a primer inserts made by joining 2 or more portions.

STATEMENT OF FEDERALLY FUNDED RESEARCH

Not Applicable.

INCORPORATION-BY-REFERENCE OF MATERIALS FILED ON COMPACT DISC

Not Applicable.

BACKGROUND OF THE INVENTION

Without limiting the scope of the invention, its background is described in connection with lightweight polymer cartridge casing ammunition. Conventional ammunition cartridge casings for rifles and machine guns, as well as larger caliber weapons, are made from brass, which is heavy, expensive, and potentially hazardous. There exists a need for an affordable lighter weight replacement for brass ammunition cartridge cases that can increase mission performance and operational capabilities. Lightweight polymer cartridge casing ammunition must meet the reliability and performance standards of existing fielded ammunition and be interchangeable with brass cartridge casing ammunition in existing weaponry. Reliable cartridge casings manufacturing requires uniformity (e.g., bullet seating, bullet-to-casing fit, casing strength, etc.) from one cartridge to the next in order to obtain consistent pressures within the casing during firing prior to bullet and casing separation to create uniformed ballistic performance. Plastic cartridge casings have been known for many years but have failed to provide satisfactory ammunition that could be produced in commercial quantities with sufficient safety, ballistic, handling characteristics, and survive physical and natural conditions to which it will be exposed during the ammunition's intended life cycle; however, these characteristics have not been achieved.

For example, U.S. Pat. No. 7,441,504 discloses a base for a cartridge casing body for an ammunition article, the base having an ignition device; an attachment device at one end thereof, the attachment device being adapted to the base to a cartridge casing body; wherein the base is made from plastic, ceramic, or a composite material.

U.S. Pat. No. 7,610,858 discloses an ammunition cartridge assembled from a substantially cylindrical polymeric cartridge casing body; and a cylindrical polymeric middle body component with opposing first and second ends, wherein the first end has a coupling element that is a mate for the projectile-end coupling element and joins the first end of the middle body component to the second end of the bullet-end component, and the second end is the end of the casing body opposite the projectile end and has a male or female coupling element; and a cylindrical cartridge casing head-end component with an essentially closed base end with a primer hole opposite an open end with a coupling element that is a mate for the coupling element on the second end of the middle body and joins the second end of the middle body component to the open end of the head-end component.

Shortcomings of the known methods of producing plastic or substantially plastic ammunition include the possibility of the projectile being pushed into the cartridge casing, the bullet pull being too light such that the bullet can fall out, the bullet pull being too insufficient to create sufficient chamber pressure, the bullet pull not being uniform from round to round, and portions of the cartridge casing breaking off upon firing causing the weapon to jam or damage or danger when subsequent rounds are fired or when the casing portions themselves become projectiles. To overcome the above shortcomings, improvements in cartridge case design and performance polymer materials are needed.

BRIEF SUMMARY OF THE INVENTION

The present invention provides an ammunition cartridge having a two piece primer insert comprising: a two piece primer insert (32) comprising: an upper primer insert portion (56) connected to a lower primer insert portion (58), wherein the upper primer insert portion (56) comprises an upper primer bottom surface (34), an upper primer aperture (33) through the upper primer bottom surface (34), and a substantially cylindrical coupling element (30) extending away from the upper primer bottom surface (34), wherein the lower primer insert portion (58) comprises: a lower primer bottom surface (35) opposite a lower primer top surface (36), a primer recess (38) in the lower primer top surface (36) that extends toward the lower primer bottom surface (35) and adapted to fit a primer, a lower flash hole aperture (37) through the lower primer bottom surface (35), wherein the lower flash hole aperture (37) is larger than the upper primer aperture (33) to form a flash hole groove (39) in the primer recess (38); a polymeric middle body extending from a middle body coupling region over the two piece primer insert and into the flash hole groove to form a flash hole, wherein the polymeric middle body comprises a first polymer; a polymeric nose portion comprising a nose coupler connected to the middle body coupling region, a shoulder extending from the nose coupler, a neck extending from the shoulder and a projectile aperture in the neck, wherein the nose portion comprises a second polymer; and a propellant chamber defined between the flash hole and the projectile aperture. The two piece primer insert may include a primer flash aperture groove positioned in the primer recess around the primer flash aperture and the first polymer composition extends into the primer flash aperture to form a flash hole. The first polymer composition, the second polymer composition or both comprise a nylon polymer. The first polymer composition, the second polymer composition or both comprise a fiber-reinforced polymeric composite e.g., between about 10 and about 70 wt % glass fiber fillers, mineral fillers, or mixtures thereof. The bullet aperture may include one or more cannelures formed on an inner circumferential surface of the bullet aperture. The substantially cylindrical coupling region and the polymeric bullet-end coupling may be welded or bonded together. The first polymer composition, the second polymer composition or both may be polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers. The projectile may be a 223, 0.243, 0.25-06, 0.270, 0.300, 0.308, 0.338, 0.30-30, 0.30-06, 0.45-70 or 0.50-90, 50 caliber, 45 caliber, 380 caliber or 38 caliber, 5.56 mm, 6 mm, 7 mm, 7.62 mm, 8 mm, 9 mm, 10 mm, 12.7 mm, 14.5 mm, 14.7 mm, 20 mm, 25 mm, 30 mm, 40 mm, 57 mm, 60 mm, 75 mm, 76 mm, 81 mm, 90 mm, 100 mm, 105 mm, 106 mm, 115 mm, 120 mm, 122 mm, 125 mm, 130 mm, 152 mm, 155 mm, 165 mm, 175 mm, 203 mm or 460 mm, 4 inch, 4.2 inch or 8 inch. The projectile may have a frustoconical shaped nose. The frustoconical shape may be a cavity to form a hollow point projectile. The projectile may have a spritzer shaped nose and/or a boattail shaped base. The upper primer insert portion, the lower primer insert portion or both may be independently formed by metal injection molding, polymer injection molding, stamping, milling, molding, machining, punching, fine blanking, smelting, or any other method that will form insert portions that may be joined together to form a primer insert. The upper primer insert portion, the lower primer insert portion or both independently comprises a polymer, a metal, an alloy, or a ceramic alloy. The ammunition of claim 4, wherein the upper primer insert portion and the lower primer insert portion may be made of the same material or different materials. A flash hole groove may extend circumferentially about the upper primer aperture or the lower primer aperture.

The present invention includes an ammunition cartridge having a three piece primer insert comprising: an upper primer insert portion comprising an upper primer bottom surface opposite an upper primer top surface, an upper primer aperture through the upper primer bottom surface and the an upper primer top surface; a flash hole groove that extends circumferentially about the upper primer aperture on the upper primer bottom surface, a substantially cylindrical coupling element extending away from the upper primer top surface, and an interior surface inside the substantially cylindrical coupling element; a lower primer insert portion comprising a lower primer bottom surface opposite a lower primer top surface, a primer recess in the lower primer top surface that extends toward the lower primer bottom surface and adapted to fit a primer, and a lower primer aperture through the lower primer bottom surface; an insert joint that links the upper primer bottom surface and the lower primer bottom surface to align the lower primer aperture and form a primer insert; a flange portion comprising a flange top surface opposite a flange bottom surface, a flange primer aperture extending from the flange top surface to the flange bottom surface, and a flange that extends circumferentially about an outer edge of the flange bottom surface, wherein the flange is adapted to receive a polymer overmolding; and a flange joint that links the flange bottom surface and the lower primer bottom surface to align the flange primer aperture and the lower primer aperture to form a primer insert, wherein the insert joint is smelted, sintered, adhesive bonded, laser welded, ultrasonic welded, friction spot welded, or friction stir welded, wherein the flange joint is smelted, sintered, adhesive bonded, laser welded, ultrasonic welded, friction spot welded, and friction stir welded, wherein the upper primer insert portion, the lower primer insert portion or both independently formed by metal injection molding, polymer injection molding, stamping, milling, molding, machining, punching, fine blanking, smelting, or any other method that will form insert portions that may be joined together to form a primer insert; a substantially cylindrical polymeric middle body extending from the substantially cylindrical primer insert to a cylindrical middle body coupling region molded from a first polymer, wherein the first polymer is molded over the flange, the inner circumferential surface and the outer surface and extends to the cylindrical middle body coupling region; a substantially cylindrical polymeric projectile end mated to the substantially cylindrical polymeric middle body, wherein the substantially cylindrical polymeric projectile end comprises a projectile end coupling region that extends to a shoulder region that reduces to a neck region having a projectile aperture wherein the projectile end coupling region couples to the middle body coupling region; and a propellant chamber defined between the primer flash aperture and the projectile aperture.

The present invention includes an ammunition cartridge having a two piece primer insert comprising: a two piece insert comprising: an upper primer insert portion comprising an upper primer bottom surface, an upper primer aperture through the upper primer bottom surface; a substantially cylindrical coupling element extending away from the upper primer bottom surface, and an interior surface inside the substantially cylindrical coupling element; a lower primer insert portion comprising a lower primer bottom surface opposite a lower primer top surface, a flash hole groove that extends circumferentially about the upper primer aperture or the lower primer aperture, and the first polymer composition extends into the primer flash aperture to form a flash hole, a primer recess in the lower primer top surface that extends toward the lower primer bottom surface and adapted to fit a primer, a lower primer aperture through the lower primer bottom surface, and a flange that extends circumferentially about an outer edge of the lower primer top surface, wherein the flange is adapted to receive a polymer overmolding; and an insert joint that links the upper primer bottom surface and the lower primer bottom surface to align the lower primer aperture and form a primer insert; a substantially cylindrical polymeric middle body extending from the substantially cylindrical primer insert to a cylindrical middle body coupling region molded from a first polymer, wherein the first polymer is molded over the flange, the inner circumferential surface and the outer surface and extends to the cylindrical middle body coupling region; a substantially cylindrical polymeric projectile end mated to the substantially cylindrical polymeric middle body, wherein the substantially cylindrical polymeric projectile end comprises a projectile end coupling region that extends to a shoulder region that reduces to a neck region having a projectile aperture wherein the projectile end coupling region couples to the middle body coupling region; and a propellant chamber defined between the primer flash aperture and the projectile aperture.

BRIEF DESCRIPTION OF THE SEVERAL VIEWS OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1:
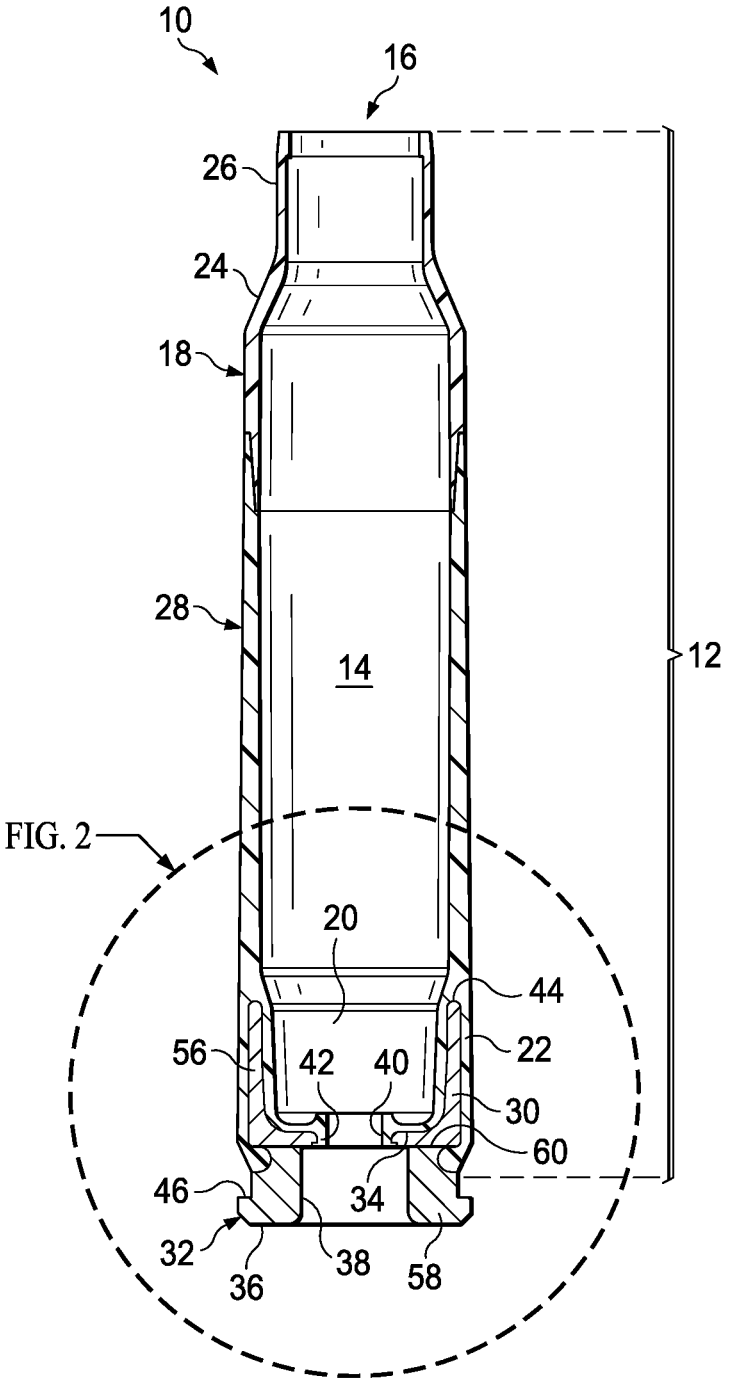
FIG. 1 depicts a side, cross-sectional view of a polymeric cartridge case according to one embodiment of the present invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Reliable cartridge manufacture requires uniformity from one cartridge to the next in order to obtain consistent ballistic performance. Among other considerations, proper bullet seating and bullet-to-casing fit is required. In this manner, a desired pressure develops within the casing during firing prior to bullet and casing separation. Historically, bullets employ a cannelure, which is a slight annular depression formed in a surface of the bullet at a location determined to be the optimal seating depth for the bullet. In this manner, a visual inspection of a cartridge could determine whether or not the bullet is seated at the proper depth. Once the bullet is inserted into the casing to the proper depth, one of two standard procedures is incorporated to lock the bullet in its proper location. One method is the crimping of the entire end of the casing into the cannelure. A second method does not crimp the casing end; rather the bullet is pressure fitted into the casing.

The polymeric ammunition cartridges of the present invention are of a caliber typically carried by soldiers in combat for use in their combat weapons. The present invention is not limited to the described caliber and is believed to be applicable to other calibers as well. This includes various small and medium caliber munitions, including 5.56 mm, 7.62 mm, 308, 338, 3030, 3006, and .50 caliber ammunition cartridges, as well as medium/small caliber ammunition such as 380 caliber, 38 caliber, 9 mm, 10 mm, 20 mm, 25 mm, 30 mm, 40 mm, 45 caliber and the like. The projectile and the corresponding cartridge may be of any desired size, e.g., .223, 243, .25-06, .270, .300, 308, 0.338, .30-30, .30-06, .45-70 or .50-90, 50 caliber, 45 caliber, 380 caliber or 38 caliber, 5.56 mm, 6 mm, 7 mm, 7.62 mm, 8 mm, 9 mm, 10 mm, 12.7 mm, 14.5 mm, 14.7 mm, 20 mm, 25 mm, 30 mm, 40 mm, 57 mm, 60 mm, 75 mm, 76 mm, 81 mm, 90 mm, 100 mm, 105 mm, 106 mm, 115 mm, 120 mm, 122 mm, 125 mm, 130 mm, 152 mm, 155 mm, 165 mm, 175 mm, 203 mm or 460 mm, 4.2 inch or 8 inch. The cartridges, therefore, are of a caliber between about .05 and about 5 inches. Thus, the present invention is also applicable to the sporting goods industry for use by hunters and target shooters.

The present invention includes primer inserts that are made as a multi-piece insert. In one embodiment the multi-piece insert is a 2 piece insert but may be a 3, 4, 5, or 6 piece insert. Regardless of the number of pieces the multi-piece insert each piece may be of similar or dissimilar materials that are connected to form a unitary primer insert. The portions of the primer insert may be constructed from dissimilar materials including metal-to-metal, polymer-to-polymer and metal-to-polymer joints. The individual pieces may be joined using various methods including smelting, sintering, adhesive bonding, welding techniques that joining dissimilar materials, including laser welding, ultrasonic welding, friction spot welding, and friction stir welding. The method of connecting the individual pieces to form a unitary insert will depend on the materials being joined. For example, a metal insert may is constructed from 2 or more metal pieces with similar melting points are joined together to form a unitary insert through sintering.

The substantially cylindrical primer insert 32 includes at least an upper primer insert portion 56 and a lower primer insert portion 58 joined at insert joint 60. Although, there can be 3, 4, 5, 6, or more portions. In addition the portions may be in the vertical axis instead of the horizontal axis as shown in the figures. For example, the interior portion may be a first portion, the outer portion a second portion and the lower section may be a third portion, and the outer portion a fourth portion.

Regardless of the number of section each portion may be made from a single material that is milled, stamped, forged, machined, molded, cast or other method of forming a primer insert portion.

FIG. 1 depicts a side, cross-sectional view of a portion of a polymeric cartridge case having a two piece primer insert. A cartridge 10 is shown manufactured with a polymer casing 12 showing a propellant chamber 14 with projectile aperture at the forward end opening 16. The polymer casing 12 has a substantially cylindrical open-ended polymeric bullet-end 18 extending from forward end opening 16 rearward to opposite end 20.

The bullet-end component 18 may be formed with the coupling end 22 formed on the end 20. The coupling end 22 is shown as a female element, but may also be configured as a male element in alternate embodiments of the invention. The forward end of bullet-end component 18 has a shoulder 24 forming chamber neck 26. The bullet-end component typically has a wall thickness between about 0.003 and about 0.200 inches; more preferably between about 0.005 and about 0.150; and more preferably between about 0.010 and about 0.050 inches.

The middle body component 28 is connected to a substantially cylindrical coupling element 30 of the substantially cylindrical insert 32. The coupling element 30, as shown may be configured as a male element, however, all combinations of male and female configurations is acceptable for the coupling elements 30 and the coupling end 22 in alternate embodiments of the invention. The coupling end 22 of bullet-end component 18 fits about and engages the coupling element 30 of a substantially cylindrical insert 32.

The substantially cylindrical primer insert 32 has an upper primer insert portion 56 and a lower primer insert portion 58 joined at insert joint 60. The upper primer insert portion 56 may be of the same or different materials than lower primer insert portion 58. The insert joint 60 mates the upper primer insert portion 56 and the lower primer insert portion 58 while retaining the primer flash hole 40. The insert joint 60 mates the upper primer insert portion 56 and the lower primer insert portion 58 by welding or bonding using solvent, adhesive, spin-welding, vibration-welding, ultrasonic-welding or laser-welding techniques. In addition multiple methods may be used to increases the joint strength. The upper primer insert portion 56 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer recess 38 and extends through the bottom surface 34 into the propellant chamber 14.

The coupling end 22 extends the polymer through the primer flash hole 40 to form an aperture coating 42 while retaining a passage from the top surface 36 through the bottom surface 34 and into the propellant chamber 14 to provide support and protection about the primer flash hole 40. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. The polymer casing 12 also has a substantially cylindrical open-ended middle body component 28. The middle body component extends from a forward end opening 16 to the coupling element 22. The middle body component typically has a wall thickness between about 0.003 and about 0.200 inches; and more preferably between about 0.005 and about 0.150 inches; and more preferably between about 0.010 and about 0.050 inches. The bullet-end 16, middle body 18 and bottom surface 34 define the interior of propellant chamber 14 in which the powder charge (not shown) is contained. The interior volume of the propellant chamber 14 may be varied to provide the volume necessary for complete filling of the chamber 14 by the propellant chosen so that a simplified volumetric measure of propellant can be utilized when loading the cartridge. Either a particulate or consolidated propellant can be used. The lower primer insert portion 58 also has a flange 46 and a primer recess 38 formed therein for ease of insertion of the primer (not shown). The primer recess 38 is sized so as to receive the primer (not shown) in an interference fit during assembly. A primer flash hole 40 communicates through the bottom surface 34 of substantially cylindrical insert 32 into the propellant chamber 14 so that upon detonation of primer (not shown) the powder (not shown) in propellant chamber 14 will be ignited.

The projectile (not shown) is held in place within chamber case neck 26 at forward opening 16 by an interference fit. Mechanical crimping of the forward opening 16 can also be applied to increase the bullet pull force holding the bullet (not shown) in place. The bullet (not shown) may be inserted into place following the completion of the filling of propellant chamber 14. The projectile (not shown) can also be injection molded directly onto the forward opening 16 prior to welding or bonding together using solvent, adhesive, spin-welding, vibration-welding, ultrasonic-welding or laser-welding techniques. The welding or bonding increases the joint strength so the casing can be extracted from the hot gun casing after firing at the cook-off temperature.

The bullet-end 18 and bullet components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature. An optional first and second annular groove (cannelures) may be provided in the bullet-end in the interlock surface of the male coupling element to provide a snap-fit between the two components. The cannelures formed in a surface of the bullet at a location determined to be the optimal seating depth for the bullet. The bullet is inserted into the casing to the depth to lock the bullet in its proper location. One method is the crimping of the entire end of the casing into the cannelures. The bullet-end and middle body components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature.

Figure 2:
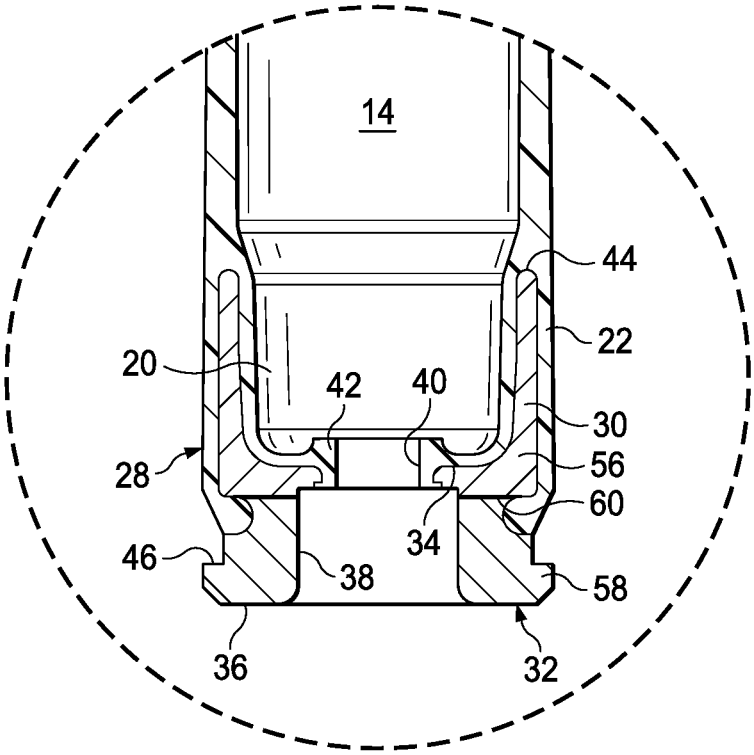
FIG. 2 depicts a side, cross-sectional view of a portion of the polymeric cartridge case according to one embodiment of the present invention.

FIG. 2 depicts a side, cross-sectional view of a portion of the polymeric cartridge case having a two piece primer insert. The substantially cylindrical primer insert 32 has an upper primer insert portion 56 and a lower primer insert portion 58 joined at insert joint 60. The upper primer insert portion 56 may be of the same or different materials than lower primer insert portion 58. The upper primer insert portion 56 mates to the lower primer insert portion 58 at insert joint 60 while retaining the primer flash hole 40 and the primer recess 38. The insert joint 60 may connect the upper primer insert portion 56 and the lower primer insert portion 58 by welding or bonding using solvent, adhesive, spin-welding, vibration-welding, ultrasonic-welding or laser-welding techniques. In addition, multiple methods may be used to increase the joint strength. The upper primer insert portion 56 includes a substantially cylindrical coupling element 30 extending from a bottom surface 34 that is opposite a top surface 36. The coupling element 30 extends with a taper to a smaller diameter at the tip 44. Located in the top surface 36 is a primer recess 38 that extends toward the bottom surface 34. A primer flash hole 40 is located in the primer recess 38 and extends through the bottom surface 34 into the propellant chamber 14. The coupling end 22 of the middle body extends the polymer through the primer flash hole 40 to form an aperture coating 42 while retaining a passage from the top surface 36 through the bottom surface 34 and into the propellant chamber 14 to provide support and protection about the primer flash hole 40. When overmolded the coupling end 22 interlocks with the substantially cylindrical coupling element 30. The coupling element 30 extends with a taper to a smaller diameter at the tip 44 to physical interlock the substantially cylindrical insert 32 to the middle body component. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer recess 38 and extends through the bottom surface 34 into the propellant chamber 14. The coupling end 22 extends the polymer through the primer flash hole 40 to form an aperture coating 42 while retaining a passage from the top surface 36 through the bottom surface 34 and into the propellant chamber 14 to provide support and protection about the primer flash hole 40. When contacted the coupling end 22 interlocks with the substantially cylindrical coupling element 30, through the coupling element 30 that extends with a taper to a smaller diameter at the tip 44 to physical interlock the substantially cylindrical insert 32 and the middle body component 28.

Figure 3:
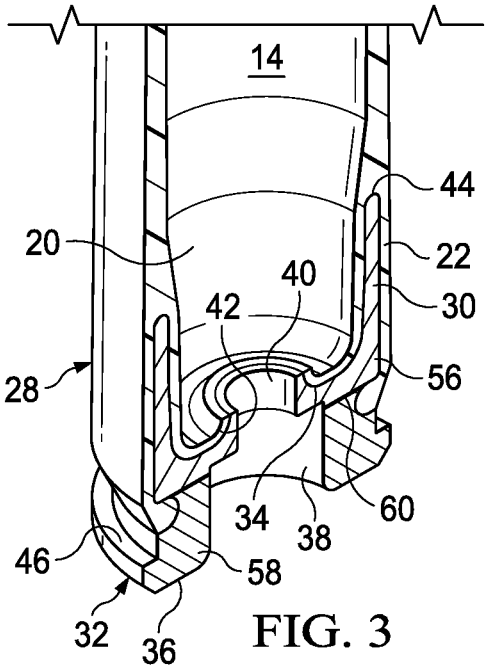
FIG. 3 depicts a side, cross-sectional view of a portion of the polymeric cartridge case having a two piece primer insert.

FIG. 3 depicts a side, cross-sectional view of a portion of the polymeric cartridge case having a two piece primer insert. The substantially cylindrical primer insert 32 has an upper primer insert portion 56 and a lower primer insert portion 58 joined at insert joint 60. The upper primer insert portion 56 may be of the same or different materials than lower primer insert portion 58. The upper primer insert portion 56 mates to the lower primer insert portion 58 at insert joint 60 while retaining the primer flash hole 40 and the primer recess 38. The insert joint 60 may connect the upper primer insert portion 56 and the lower primer insert portion 58 by welding or bonding using solvent, adhesive, spin-welding, vibration-welding, ultrasonic-welding or laser-welding techniques. In addition, multiple methods may be used to increase the joint strength. The upper primer insert portion 56 includes a substantially cylindrical coupling element 30 extending from a bottom surface 34 that is opposite a top surface 36. The coupling element 30 extends with a taper to a smaller diameter at the tip 44. Located in the top surface 36 is a primer recess 38 that extends toward the bottom surface 34. A primer flash hole 40 is located in the primer recess 38 and extends through the bottom surface 34 into the propellant chamber 14. The coupling end 22 of the middle body extends the polymer up to the primer flash hole 40 while retaining a passage from the top surface 36 through the bottom surface 34 and into the propellant chamber 14. When over-molded the coupling end 22 interlocks with the substantially cylindrical coupling element 30. The coupling element 30 extends with a taper to a smaller diameter at the tip 44 to physical interlock the substantially cylindrical insert 32 to the middle body component. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer recess 38 and extends through the bottom surface 34 into the propellant chamber 14. The coupling end 22 extends the polymer through the primer flash hole 40 to form an aperture coating 42 while retaining a passage from the top surface 36 through the bottom surface 34 and into the propellant chamber 14 to provide support and protection about the primer flash hole 40. When contacted the coupling end 22 interlocks with the substantially cylindrical coupling element 30, through the coupling element 30 that extends with a taper to a smaller diameter at the tip 44 to physical interlock the substantially cylindrical insert 32 and the middle body component 28.

Figure 4:
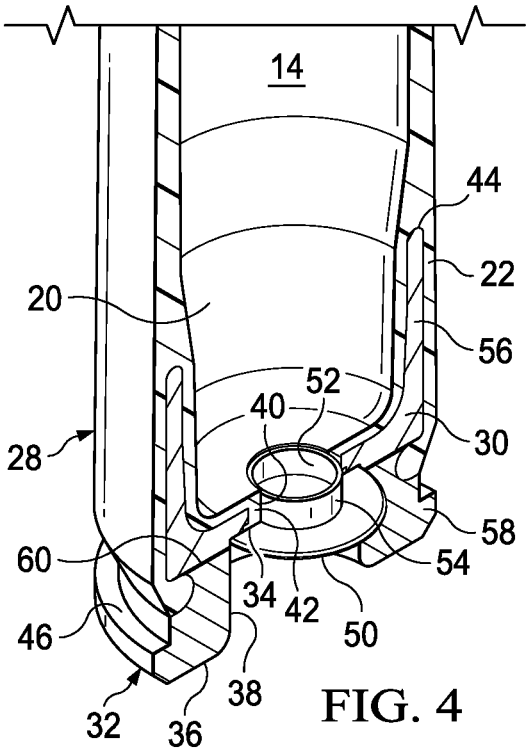
FIG. 4 depicts a side, cross-sectional view of a portion of the polymeric cartridge case having a two piece primer insert and a diffuser.
Figure 5A:
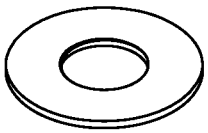
FIGS. 5A-5H depict different embodiment of the diffuser of the present invention.
Figure 5B:
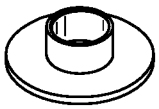
Figure 5C:
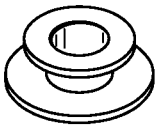
Figure 5D:
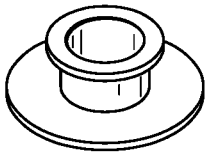
Figure 5E:
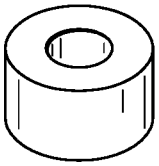
Figure 5F:
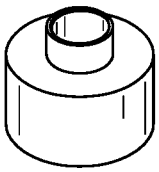
Figure 5G:
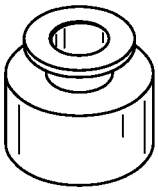
Figure 5H:
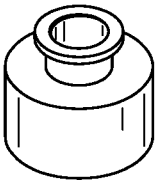

FIG. 4 depicts a side, cross-sectional view of a portion of the polymeric cartridge case having a two piece primer insert and a diffuser. The substantially cylindrical primer insert 32 has an upper primer insert portion 56 and a lower primer insert portion 58 joined at insert joint 60. The upper primer insert portion 56 may be of the same or different materials than lower primer insert portion 58. The upper primer insert portion 56 mates to the lower primer insert portion 58 at insert joint 60 while retaining the primer flash hole 40 and the primer recess 38. The insert joint 60 may connect the upper primer insert portion 56 and the lower primer insert portion 58 by welding or bonding using solvent, adhesive, spin-welding, vibration-welding, ultrasonic-welding or laser-welding techniques. In addition, multiple methods may be used to increase the joint strength. The upper primer insert portion 56 includes a substantially cylindrical coupling element 30 extending from a bottom surface 34 that is opposite a top surface 36. The coupling element 30 extends with a taper to a smaller diameter at the tip 44. Located in the top surface 36 is a primer recess 38 that extends toward the bottom surface 34. A primer flash hole 40 is located in the primer recess 38 and extends through the bottom surface 34 into the propellant chamber 14. The coupling end 22 of the middle body extends the polymer through the primer flash hole 40 to form an aperture coating 42 while retaining a passage from the top surface 36 through the bottom surface 34 and into the propellant chamber 14 to provide support and protection about the primer flash hole 40. When over-molded the coupling end 22 interlocks with the substantially cylindrical coupling element 30. The coupling element 30 extends with a taper to a smaller diameter at the tip 44 to physical interlock the substantially cylindrical insert 32 to the middle body component. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer recess 38 and extends through the bottom surface 34 into the propellant chamber 14. The coupling end 22 extends the polymer through the primer flash hole 40 to form an aperture coating 42 while retaining a passage from the top surface 36 through the bottom surface 34 and into the propellant chamber 14 to provide support and protection about the primer flash hole 40. When contacted the coupling end 22 interlocks with the substantially cylindrical coupling element 30, through the coupling element 30 that extends with a taper to a smaller diameter at the tip 44 to physical interlock the substantially cylindrical insert 32 and the middle body component 28. The diffuser 50 includes a diffuser aperture 52 and a diffuser aperture extension 54 that aligns with the primer flash hole 40. The diffuser 50 diverts the combustion effect away from the over-molded polymer material of the middle body component 28. The affects being the impact from igniting the primer as far as pressure and heat to divert the energy of the primer off of the polymer and directing it to the flash hole. The diffuser 50 can be between 0.004 to 0.010 inches (e.g., 0.0001, 0.0002, 0.0003, 0.0004, 0.0005, 0.0006, 0.0007, 0.0008, 0.0009, 0.001, 0.002, 0.003, 0.004, 0.005, 0.006, 0.007, 0.008, 0.009, 0.010, 0.011, 0.012, 0.013, 0.014, or 0.015) in thickness and made from metal, polymer, composite, or other material, e.g., half hard brass. For example, the diffuser 50 can be between about 0.005 inches thick for a 5.56 diffuser 50. The outer diameter of the diffuser for a 5.56 or 223 case is 0.173 and the inner diameter is 0.080. The diffuser could be made of any material that can withstand the energy from the ignition of the primer, e.g., alloys, metals, steel, stainless, cooper, aluminum, resins and polymers. The diffuser 50 can be produce in "T", 'L" or "I" shape by drawing the material by MIM, PIM, milling, machining, or using a stamping and draw die. In the "T", 'L" or "I" shape diffusers the center ring can be 0.005 to 0.010 tall and the outer diameter is 0.090 and the inner diameter 0.080, individually 0.001, 0.002, 0.003, 0.004, 0.005, 0.006, 0.007, 0.008, 0.009, 0.010, 0.011, 0.012, 0.013, 0.014, 0.015, 0.02, 0.02.5, 0.03, 0.04, 0.05, 0.06, 0.07, 0.08, 0.09, 0.1, or 0.2.

FIGS. 5A-5H depict different embodiment of the diffuser of the present invention.

Figure 6A:
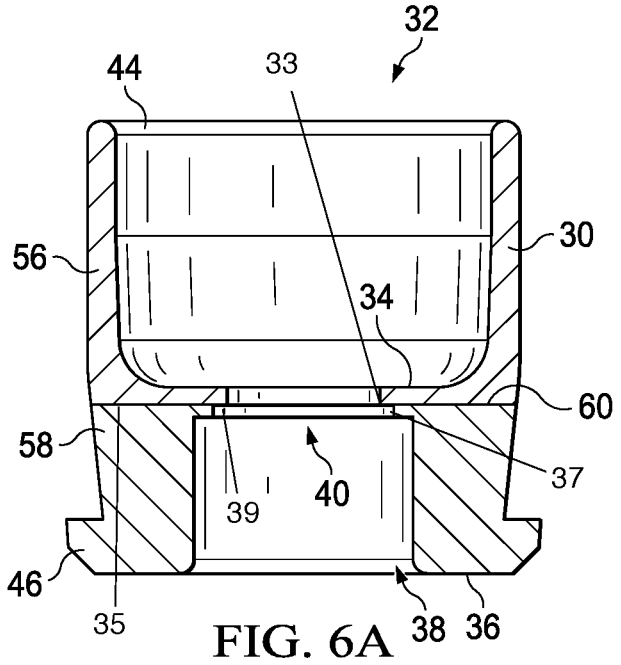
FIGS. 6A-6D depicts a side, cross-sectional view of a two piece primer insert used in a polymeric cartridge case.

FIG. 6A depict a side, cross-sectional view of a two piece primer insert used in a polymeric cartridge case. The two piece primer insert (32) comprises: an upper primer insert portion (56) connected to a lower primer insert portion (58), wherein the upper primer insert portion (56) comprises an upper primer bottom surface (34), an upper primer aperture (33) through the upper primer bottom surface (34), and a substantially cylindrical coupling element (30) extending away from the upper primer bottom surface (34), wherein the lower primer insert portion (58) comprises: a lower primer bottom surface (35) opposite a lower primer top surface (36), a primer recess (38) in the lower primer top surface (36) that extends toward the lower primer bottom surface (35) and adapted to fit a primer, a lower flash hole aperture (37) through the lower primer bottom surface (35), wherein the lower flash hole aperture (37) is larger than the upper primer aperture (33) to form a flash hole groove (39) in the primer recess (38)

Figure 6B:
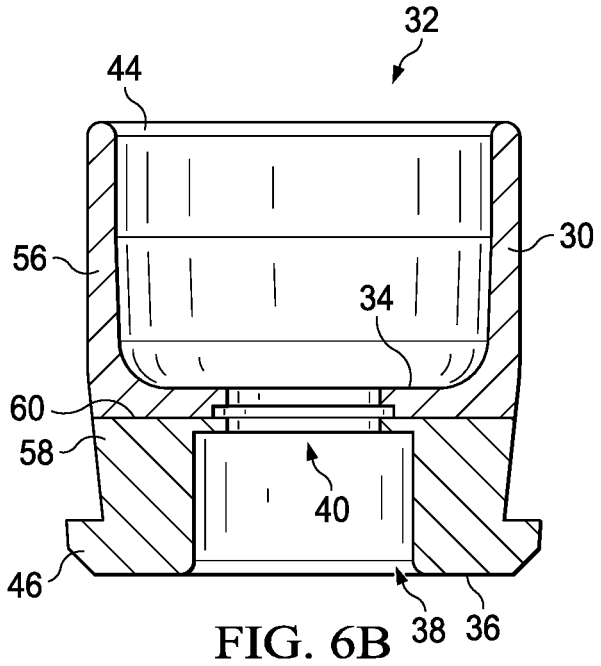
Figure 6C:
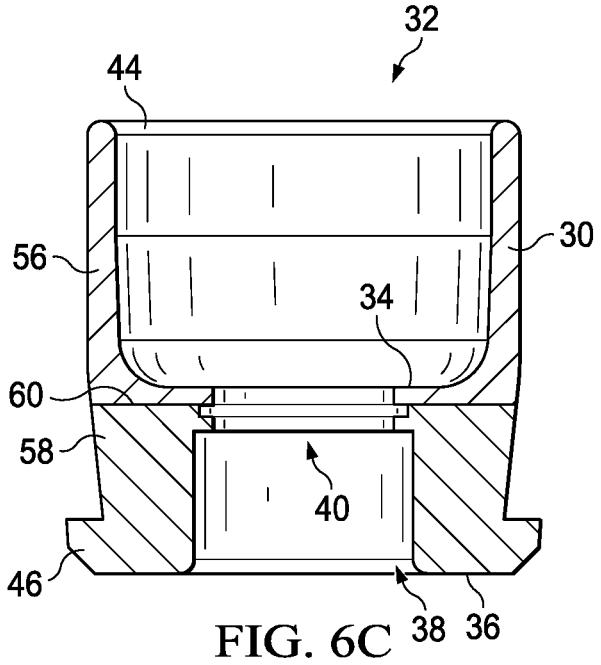
Figure 6D:
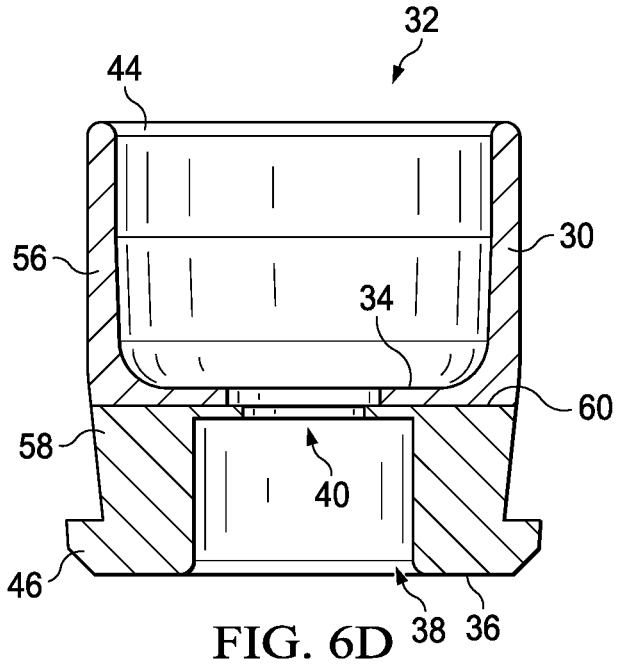

FIGS. 6B-6D depict a side, cross-sectional view of a two piece primer insert used in a polymeric cartridge case. The substantially cylindrical primer insert 32 has an upper primer insert portion 56 and a lower primer insert portion 58 joined at insert joint 60. The upper primer insert portion 56 may be of the same or different materials than lower primer insert portion 58. The upper primer insert portion 56 mates to the lower primer insert portion 58 at insert joint 60 while retaining the primer flash hole 40 and the primer recess 38. The insert joint 60 may connect the upper primer insert portion 56 and the lower primer insert portion 58 by welding or bonding using solvent, adhesive, spin-welding, vibration-welding, ultrasonic-welding or laser-welding techniques. In addition, multiple methods may be used to increase the joint strength. The upper primer insert portion 56 includes a substantially cylindrical coupling element 30 extending from a bottom surface 34 that is opposite a top surface 36. The coupling element 30 extends with a taper to a smaller diameter at the tip 44. Located in the top surface 36 is a primer recess 38 that extends toward the bottom surface 34. A primer flash hole 40 is located in the primer recess 38 and extends through the bottom surface 34 into the propellant chamber 14. The coupling end 22 of the middle body extends the polymer through the primer flash hole 40 to form an aperture coating (not shown) while retaining a passage from the top surface 36 through the bottom surface 34 and into the propellant chamber 14 to provide support and protection about the primer flash hole 40. When overmolded the coupling end 22 interlocks with the substantially cylindrical coupling element 30. The coupling element 30 extends with a taper to a smaller diameter at the tip 44 to physical interlock the substantially cylindrical insert 32 to the middle body component. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer recess 28 and extends through the bottom surface 34 into the propellant chamber 14. The coupling end 22 extends the polymer through the primer flash hole 40 to form an aperture coating (not shown) while retaining a passage from the top surface 36 through the bottom surface 34 and into the propellant chamber 14 to provide support and protection about the primer flash hole 40. When contacted the coupling end 22 interlocks with the substantially cylindrical coupling element 30, through the coupling element 30 that extends with a taper to a smaller diameter at the tip 44 to physical interlock the substantially cylindrical insert 32 and the middle body component 28.

The present invention provides a method of making a multi-piece insert that is joined to form a unitary insert that can be overmolded into an ammunition cartridge. The individual components of the insert may be made may any method provided the insert is functional.

For example, the individual pieces may be stamped or milled and then connected. The connection can also be of any mechanism that is available currently that produces a viable insert with the desired joint strength. For example, the joint may be welded or soldered as in FIG. 7A or riveted or coined as in FIG. 7B.

Figure 7A:
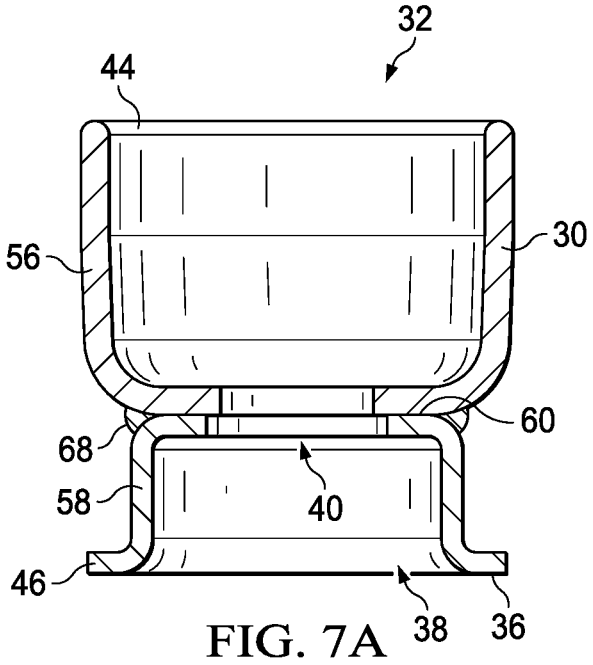
FIGS. 7A-7B depicts a side, cross-sectional view of a stamped two piece primer insert used in a polymeric cartridge case.
Figure 7B:
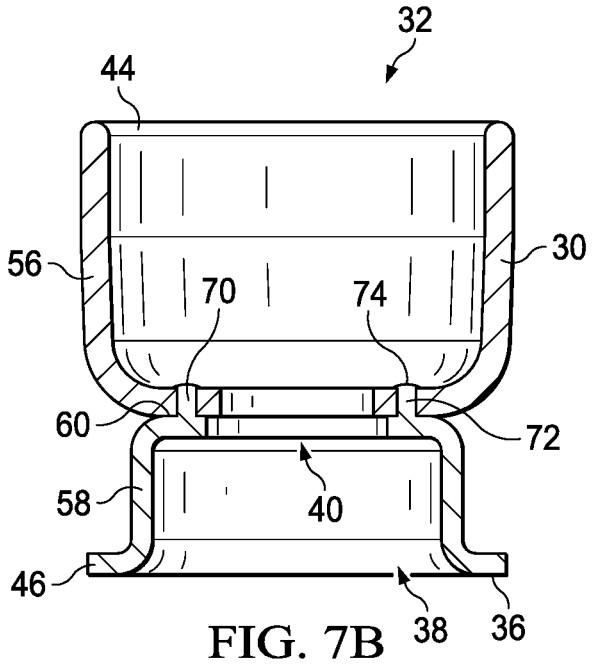

FIGS. 7A-7B depict a side, cross-sectional view of a two piece primer insert used in a polymeric cartridge case. The substantially cylindrical primer insert 32 has an upper primer insert portion 56 and a lower primer insert portion 58 joined at insert joint 60. The upper primer insert portion 56 may be of the same or different materials than lower primer insert portion 58. The upper primer insert portion 56 mates to the lower primer insert portion 58 at insert joint 60 while retaining the primer flash hole 40 and the primer recess 38. The insert joint 60 may connect the upper primer insert portion 56 and the lower primer insert portion 58 by soldering, welding spin-welding, vibration-welding, ultrasonic-welding or laser-welding techniques as in FIG. 7A. FIG. 7A shows a weld 68 joining the upper primer insert portion 56 and the lower primer insert portion 58. The weld 68 circumferentially surrounds the insert joint 60. FIG. 7B shows both a riveted and a coined method of joining the upper primer insert portion 56 and the lower primer insert portion 58. The lower primer insert portion 58 has a rivet 70 that extends through the upper primer insert portion 56 and secures the upper primer insert portion 56 and the lower primer insert portion 58. FIG. 7B also shows a coined method of joining the upper primer insert portion 56 and the lower primer insert portion 58. The lower primer insert portion 58 has a stud 72 that extends through the upper primer insert portion 56 and is coined 74 to secure the upper primer insert portion 56 and the lower primer insert portion 58. In addition, multiple methods may be used to increase the joint strength. The upper primer insert portion 56 includes a substantially cylindrical coupling element 30 extending from a bottom surface 34 that is opposite a top surface 36. The coupling element 30 extends with a taper to a smaller diameter at the tip 44. Located in the top surface 36 is a primer recess 38 that extends toward the bottom surface 34. A primer flash hole 40 is located in the primer recess 38 and extends through the bottom surface 34 into the propellant chamber 14. The coupling end 22 of the middle body extends the polymer through the primer flash hole 40 to form an aperture coating (not shown) while retaining a passage from the top surface 36 through the bottom surface 34 and into the propellant chamber 14 to provide support and protection about the primer flash hole 40. When over-molded the coupling end 22 interlocks with the substantially cylindrical coupling element 30. The coupling element 30 extends with a taper to a smaller diameter at the tip 44 to physical interlock the substantially cylindrical insert 32 to the middle body component. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer recess 28 and extends through the bottom surface 34 into the propellant chamber 14. The coupling end 22 extends the polymer through the primer flash hole 40 to form an aperture coating (not shown) while retaining a passage from the top surface 36 through the bottom surface 34 and into the propellant chamber 14 to provide support and protection about the primer flash hole 40. When contacted the coupling end 22 interlocks with the substantially cylindrical coupling element 30, through the coupling element 30 that extends with a taper to a smaller diameter at the tip 44 to physical interlock the substantially cylindrical insert 32 and the middle body component 28.

Figure 8A:
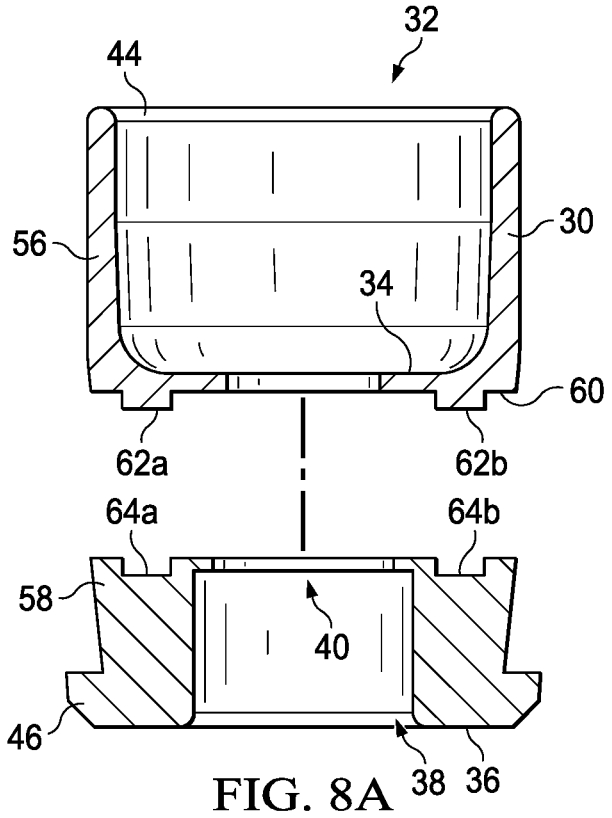
FIGS. 8A-8C depicts a side, cross-sectional view of a two piece primer insert having a tab and groove configuration used in a polymeric cartridge case.
Figure 8B:
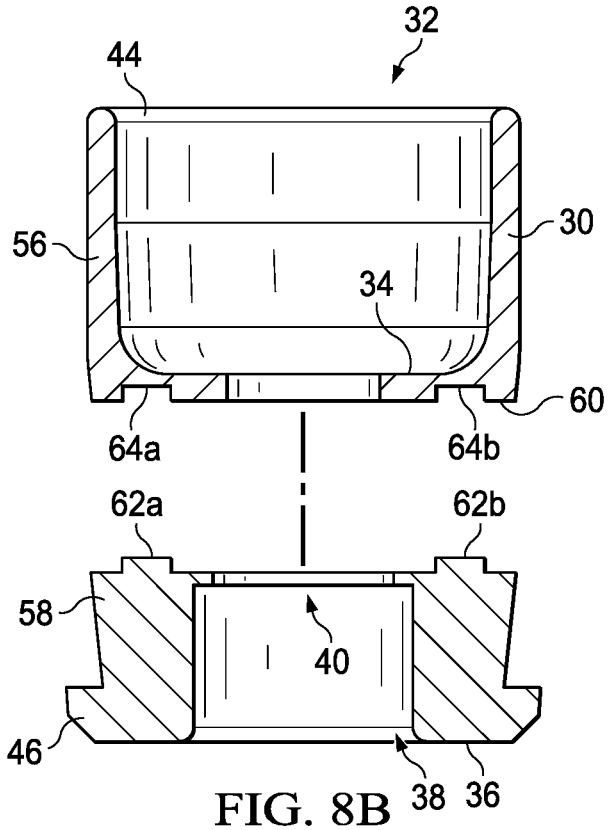
Figure 8C:
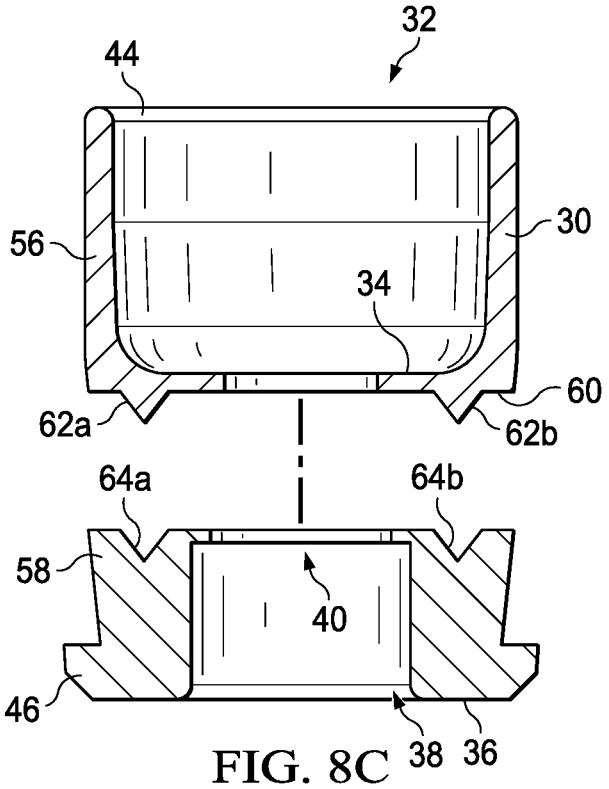

FIGS. 8A-8C depict a side, cross-sectional view of a two piece primer insert having a tab and groove configuration used in a polymeric cartridge case. The substantially cylindrical primer insert 32 has an upper primer insert portion 56 and a lower primer insert portion 58 joined at insert joint 60. The insert joint 60 has a tab 62*a* and 62*b* that mate to the corresponding groove 64*a* and 64*b* to further secure the upper primer insert portion 56 and a lower primer insert portion 58. The location, shape and position of the tab 62*a*/62*b* and groove 64*a*/64*b* may be varied by the skilled artisan as necessary to secure the upper primer insert portion 56 and a lower primer insert portion 58. The upper primer insert portion 56 may be of the same or different materials than lower primer insert portion 58. The upper primer insert portion 56 mates to the lower primer insert portion 58 at insert joint 60 while retaining the primer flash hole 40 and the primer recess 38. The insert joint 60 may connect the upper primer insert portion 56 and the lower primer insert portion 58 by welding or bonding using solvent, adhesive, spin-welding, vibration-welding, ultrasonic-welding or laser-welding techniques. In addition, multiple methods may be used to increase the joint strength. The upper primer insert portion 56 includes a substantially cylindrical coupling element 30 extending from a bottom surface 34 that is opposite a top surface 36. The coupling element 30 extends with a taper to a smaller diameter at the tip 44. Located in the top surface 36 is a primer recess 38 that extends toward the bottom surface 34. A primer flash hole 40 is located in the primer recess 38 and extends through the bottom surface 34 into the propellant chamber 14. The coupling end 22 of the middle body extends the polymer through the primer flash hole 40 to form an aperture coating (not shown) while retaining a passage from the top surface 36 through the bottom surface 34 and into the propellant chamber 14 to provide support and protection about the primer flash hole 40. When over-molded the coupling end 22 interlocks with the substantially cylindrical coupling element 30. The coupling element 30 extends with a taper to a smaller diameter at the tip 44 to physical interlock the substantially cylindrical insert 32 to the middle body component. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer recess 28 and extends through the bottom surface 34 into the propellant chamber 14. The coupling end 22 extends the polymer through the primer flash hole 40 to form an aperture coating (not shown) while retaining a passage from the top surface 36 through the bottom surface 34 and into the propellant chamber 14 to provide support and protection about the primer flash hole 40. When contacted the coupling end 22 interlocks with the substantially cylindrical coupling element 30, through the coupling element 30 that extends with a taper to a smaller diameter at the tip 44 to physical interlock the substantially cylindrical insert 32 and the middle body component 28.

Multiple piece inserts of the present invention may be configured in various ways. For example, the insert may be include three insert pieces, three insert pieces configured without the need for a diffuser, three insert pieces where one piece is a diffuser, three insert pieces where the diffuser is between the other insert pieces.

Figure 9A:
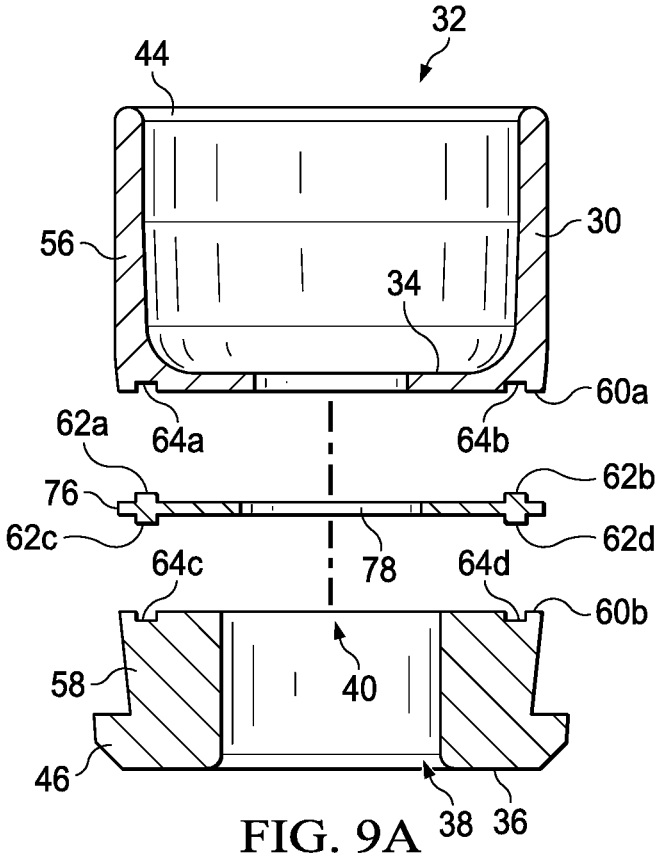
FIGS. 9A-9B depicts a side, cross-sectional view of a three piece primer insert configuration used in a polymeric cartridge case.

FIG. 9A depicts a side, cross-sectional view of a three piece primer insert having a tab and groove configuration used in a polymeric cartridge case. The substantially cylindrical primer insert 32 has an upper primer insert portion 56, a middle insert 76 and a lower primer insert portion 58 joined at the insert joints 60*a* and 60*b*. The middle insert 76 has tabs 62*a* and 62*b* that mate to the corresponding groove 64*a* and 64*b* to further secure the upper primer insert portion 56 and the middle insert 76. The middle insert 76 also has tabs 62*c* and 62*d* that mate to the corresponding groove 64*c* and 64*d* to further secure the lower primer insert portion 58 and the middle insert 76. This creates insert joint 60*a* between the upper primer insert portion 56 and the middle insert 76 and insert joint 60*b* between the lower primer insert portion 58 and the middle insert 76. The middle insert 76 has a flash hole aperture 78 that connects the upper primer insert portion 56 and the lower primer insert portion 58. In some instances the flash hole aperture 78 may have a diameter less than the diameter of the primer flash hole 40. The location, shape and position of the tab 62*a*-62*d* and groove 64*a*-64*d* may be varied by the skilled artisan as necessary to secure the upper primer insert portion 56, the middle insert 76 and the lower primer insert portion 58. The upper primer insert portion 56 may be of the same or different materials than lower primer insert portion 58. The upper primer insert portion 56 mates to the lower primer insert portion 58 at insert joint 60 while retaining the primer flash hole 40 and the primer recess 38. The insert joint 60 may connect the upper primer insert portion 56 and the lower primer insert portion 58 by welding or bonding using solvent, adhesive, spin-welding, vibration-welding, ultrasonic-welding or laser-welding techniques. In addition, multiple methods may be used to increase the joint strength. The upper primer insert portion 56 includes a substantially cylindrical coupling element 30 extending from a bottom surface 34 that is opposite a top surface 36. The coupling element 30 extends with a taper to a smaller diameter at the tip 44. Located in the top surface 36 is a primer recess 38 that extends toward the bottom surface 34. A primer flash hole 40 is located in the primer recess 38 and extends through the bottom surface 34 into the propellant chamber (not shown). The coupling end 22 of the middle body extends the polymer through the primer flash hole 40 to form an aperture coating (not shown) while retaining a passage from the top surface 36 through the bottom surface 34 and into the propellant chamber (not shown) to provide support and protection about the primer flash hole 40. When over-molded the coupling end 22 interlocks with the substantially cylindrical coupling element 30. The coupling element 30 extends with a taper to a smaller diameter at the tip 44 to physical interlock the substantially cylindrical insert 32 to the middle body component. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer recess 28 and extends through the bottom surface 34 into the propellant chamber (not shown). The coupling end 22 extends the polymer through the primer flash hole 40 to form an aperture coating (not shown) while retaining a passage from the top surface 36 through the bottom surface 34 and into the propellant chamber 14 to provide support and protection about the primer flash hole 40. When contacted the coupling end 22 interlocks with the substantially cylindrical coupling element 30, through the coupling element 30 that extends with a taper to a smaller diameter at the tip 44 to physical interlock the substantially cylindrical insert 32 and the middle body component 28.

Figure 9B:
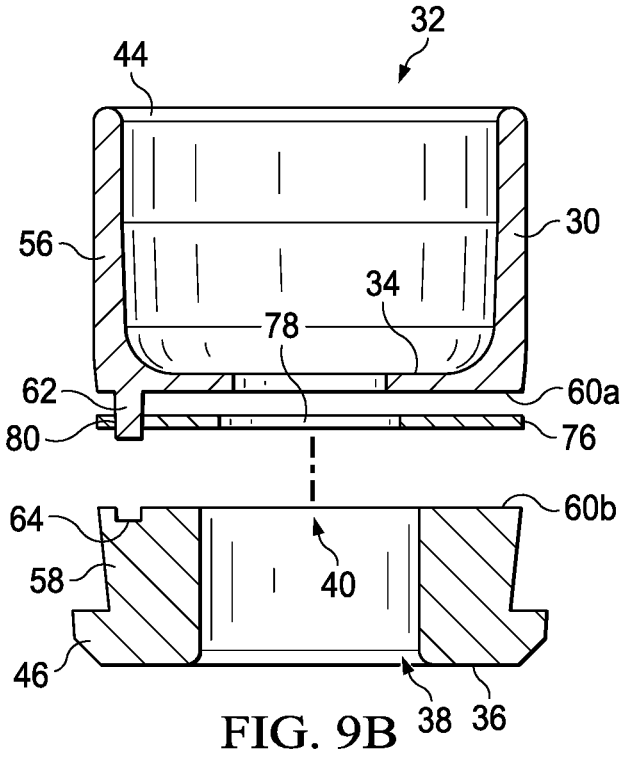

FIG. 9B depicts a side, cross-sectional view of a three piece primer insert having a tab and groove or a simple alignment configuration used in a polymeric cartridge case. The substantially cylindrical primer insert 32 has an upper primer insert portion 56, a middle insert 76 and a lower primer insert portion 58 joined at the insert joints 60*a* and 60*b*.

The middle insert 76 has a tab aperture 80 that receives the tab 62 that mate to the corresponding groove 64 to further secure the upper primer insert portion 56, the middle insert 76 and the lower primer insert portion 58. Alternatively, the middle insert 76 may be a relative flat insert that aligns with the upper primer insert portion 56 and the lower primer insert portion 58. This creates insert joint 60*a* between the upper primer insert portion 56 and the middle insert 76 and insert joint 60*b* between the lower primer insert portion 58 and the middle insert 76. The middle insert 76 has a flash hole aperture 78 that connects the upper primer insert portion 56 and the lower primer insert portion 58. In some instances, the flash hole aperture 78 may have a diameter less than the diameter of the primer flash hole 40. The location, shape and position of the tab 62 and groove 64 may be varied by the skilled artisan as necessary to secure the upper primer insert portion 56, the middle insert 76 and the lower primer insert portion 58. The upper primer insert portion 56, the middle insert 76 and the lower primer insert portion 58 may individually be of the same or different materials. The upper primer insert portion 56 mates to the middle insert 76 at insert joint 60*a* and to the lower primer insert portion 58 at insert joint 60*b* while retaining the primer flash hole 40 and the primer recess 38. The inserts joint 60*a* and 60*b* may connect the upper primer insert portion 56, the middle insert 76 and the lower primer insert portion 58 by threading, riveting, locking, friction fitting, coining, snap fitting, chemical bonding, chemical welding, soldering, smelting, sintering, adhesive bonding, laser welding, ultrasonic welding, friction spot welding, friction stir welding spin-welding, vibration-welding, ultrasonic-welding or laser-welding techniques. In addition, multiple methods may be used to increase the joint strength.

The upper primer insert portion 56 includes a substantially cylindrical coupling element 30 extending from a bottom surface 34 that is opposite a top surface 36. The coupling element 30 extends with a taper to a smaller diameter at the tip 44. Located in the top surface 36 is a primer recess 38 that extends toward the bottom surface 34. A primer flash hole 40 is located in the primer recess 38 and extends through the bottom surface 34 into the propellant chamber (not shown). The coupling end 22 of the middle body extends the polymer through the primer flash hole 40 to form an aperture coating (not shown) while retaining a passage from the top surface 36 through the bottom surface 34 and into the propellant chamber 14 to provide support and protection about the primer flash hole 40. When overmolded the coupling end 22 interlocks with the substantially cylindrical coupling element 30. The coupling element 30 extends with a taper to a smaller diameter at the tip 44 to physical interlock the substantially cylindrical insert 32 to the middle body component. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer recess 28 and extends through the bottom surface 34 into the propellant chamber 14. The coupling end 22 extends the polymer through the primer flash hole 40 to form an aperture coating (not shown) while retaining a passage from the top surface 36 through the bottom surface 34 and into the propellant chamber 14 to provide support and protection about the primer flash hole 40. When contacted the coupling end 22 interlocks with the substantially cylindrical coupling element 30, through the coupling element 30 that extends with a taper to a smaller diameter at the tip 44 to physical interlock the substantially cylindrical insert 32 and the middle body component 28.

Figure 10:
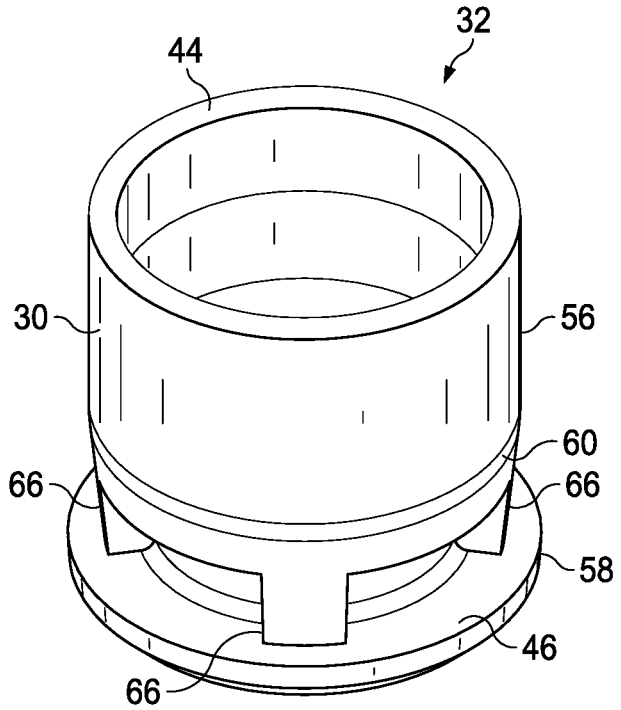
FIG. 10 depicts a perspective view of a two piece primer insert used in a polymeric cartridge case.

FIG. 10 depicts a perspective view of a two piece primer insert used in a polymeric cartridge case. The substantially cylindrical primer insert 32 has an upper primer insert portion 56 and a lower primer insert portion 58 joined at insert joint 60. The upper primer insert portion 56 may be of the same or different materials than lower primer insert portion 58. The upper primer insert portion 56 mates to the lower primer insert portion 58 at insert joint 60 while retaining the primer flash hole 40 and the primer recess (not shown). The insert joint 60 may connect the upper primer insert portion 56 and the lower primer insert portion 58 by welding or bonding using solvent, adhesive, spin-welding, vibration-welding, ultrasonic-welding or laser-welding techniques. In addition, multiple methods may be used to increase the joint strength. The upper primer insert portion 56 includes a substantially cylindrical coupling element 30 extending from a bottom surface (not shown) that is opposite a top surface (not shown). The coupling element 30 extends with a taper to a smaller diameter at the tip 44. Located in the top surface (not shown) is a primer recess (not shown) that extends toward the bottom surface (not shown). A primer flash hole (not shown) is located in the primer recess (not shown) and extends through the bottom surface (not shown) into the propellant chamber (not shown). The lower primer insert portion 58 includes a flange 46 that may have a smooth transition around the surface or may have various designs positioned around the surface. The design, shape and number of notches 66 will depend on the specific application and desire of the manufacturer but may include 1, 2, 3, 4, 5 6, 7, 8, 9, 10, or more notches.

Chemical welding and chemical bonding involves the use of chemical compositions that undergoes a chemical or physical reaction resulting in the joining of the materials and the formation of a unitary primer insert. The chemicals may join the surfaces through the formation of a layer that contacts both surfaces or by melting the surfaces to a single interface between the surfaces.

Adhesive bonding involves the use of a polymeric adhesive, which undergoes a chemical or physical reaction, for eventual joint formation. The upper primer insert portion mates to the lower primer insert portion at the insert joint to which an adhesive material has been added to form a unitary primer insert. The adhesive includes high-strength and tough adhesives that can withstand both static and alternating loads.

Sintering involves the process of compacting and forming a solid mass of material by heat and/or pressure without melting it to the point of liquefaction. Materials that are identical or similar may be sintered in the temperature range for the specific time, e.g., stainless steel may be heated for 30-60 minutes at a temperature of between 2000-2350° F. However, materials that are dissimilar may be heated at the within the common temperature range (±400° F.) for the specific time (±0.5-2 hours). For example, the upper primer insert portion may be stainless steel with a temperature range form 2000-2350° F. for 30-60 minutes and the lower primer insert portion may be nickel 1850-2100° F. for 30-45 minutes (and vice versa) to allow the sintering at between 2000-2100° F. for 30-60 minutes. Similarly, the upper primer insert portion may be stainless steel with a temperature range form 2000-2350° F. for 30-60 minutes and the lower primer insert portion may be tungsten carbide 2600-2700° F. for 20-30 minutes to allow the sintering at between 2300-2600° F. for 30-60 minutes or longer if necessary. The skilled artisan readily understands the parameters associated with sintering materials of similar and different compositions and therefor there is no need in reciting all of the various combinations that can be formed in this application.

Welding techniques including laser welding, ultrasonic welding, friction spot welding, and friction stir welding. The welding methods can use the existing materials to fill in the insert joint or an additional material may be used to fill in the insert joint. The dissimilar multi-metal welded unitary primer insert must be examined to determine the crack sensitivity, ductility, susceptibility to corrosion, etc. In some cases, it is necessary to use a third metal that is soluble with each metal in order to produce a successful joint.

The two piece primer insert used in polymeric cartridge cases includes an upper primer insert portion and a lower primer insert portion joined at insert joint. The individual upper primer insert portion and lower primer insert portion may be formed in various methods. For example the individual upper primer insert portion and lower primer insert portion may be formed by metal injection molding, polymer injection molding, stamping, milling, molding, machining, punching, fine blanking, smelting, or any other method that will form insert portions that may be joined together to form a primer insert.

The two piece primer insert includes an individual upper primer insert portion and lower primer insert portion formed in various methods. For example, the individual upper primer insert portion and lower primer insert portion may be formed by stamping, milling, or machining and then joined together to form a primer insert.

For example, the individual upper primer insert portion, the lower primer insert portion or both may be formed by fineblanking. Fineblanking is a specialty type of metal stamping that can achieve part characteristics such as flatness and a full sheared edge to a degree that is nearly impossible using a conventional metal cutting or punching process and is used to achieve flatness and cut edge characteristics that are unobtainable by conventional stamping and punching methods. When the punch makes contact with the sheet, the metal begins to deform and bulge around the point of the punch. As the yield strength of the part material is exceeded by the downward force of the press, the point of the punch begins to penetrate the metal's surface. Both the punch and matrix, or button, begin to cut from their respective sides. When the ultimate tensile strength has been reached, the metal breaks or fractures from the edge of the punch to the edge of the matrix. This results in a cut edge that appears to be partially cut and partially broken or fractured. This cut edge condition often is referred to as the "cut band." In most cases, the cut edge has about 10 percent to 30 percent of shear, and the remainder is fractured. The fracture has two primary causes. The distance between the punch and the matrix creates a leverage action and tends to pull the metal apart, causing it to rupture. The deformation that is allowed during the cutting process also allows the metal to fracture prematurely. Allowing the metal to deform severely during the cutting process results in straining of the metal, which in turn causes a stress. Trapped stresses in a product cause it to lose its flatness, which is why it is very difficult to maintain a critical flatness characteristic using conventional methods. Fineblanking requires the use of three very high-pressure pads in a special press. These pads hold the metal flat during the cutting process and keep the metal from plastically deforming during punch entry. Most fineblanking operations incorporate a V-ring into one of the high-pressure pads. This ring also is commonly referred to as a "stinger" or "impingement" ring. Before the punch contacts the part, the ring impales the metal, surrounds the perimeter of the part, and traps the metal from moving outward while pushing it inward toward the punch. This reduces rollover at the cut edge. Fineblanking operations usually require clearances of less than 0.0005 inch per side. This small clearance, combined with high pressure, results in a fully sheared part edge. Fineblanking is much like a cold extruding process. The slug (or part) is pushed or extruded out of the strip while it is held very tightly between the high-pressure holding plates and pads. The tight hold of the high-pressure plates prevents the metal from bulging or plastically deforming during the extrusion process.

The two piece primer insert includes an individual upper primer insert portion and lower primer insert portion formed in various methods. For example, the individual upper primer insert portion and lower primer insert portion may be formed by molding, injection molding or metal injection molding and then joined together to form a primer insert.

For example, when the individual upper primer insert portion and lower primer insert portion or both are metal injection molded, the raw materials are metal powders and a thermoplastic binder. There are at least two Binders included in the blend, a primary binder and a secondary binder. This blended powder mix is worked into the plasticized binder at elevated temperature in a kneader or shear roll extruder. The intermediate product is the so-called feedstock. It is usually granulated with granule sizes of several millimeters. In metal injection molding, only the binders are heated up, and that is how the metal is carried into the mold cavity.

In preparing a feedstock, it is important first to measure the actual density of each lot of both the metal powders and binders. This is extremely important especially for the metal powders in that each lot will be different based on the actual chemistry of that grade of powder. For example, 316L is comprised of several elements, such as Fe, Cr, Ni, Cu, Mo, P, Si, S and C. In order to be rightfully called a 316L, each of these elements must meet a minimum and maximum percentage weight requirement as called out in the relevant specification. Tables I-IV below provide other examples of the elemental compositions of some of the metal powders, feed stocks, metals, alloys and compositions of the present invention. Hence the variation in the chemistry within the specification results in a significant density variation within the acceptable composition range. Depending on the lot received from the powder producer, the density will vary depending on the actual chemistry received.

TABLE I

| Material Designation | Chemical Composition, % - Low-Alloy Steels | | | | |
|---|---|---|---|---|---|
| Code | Fe | Ni | Mo | C | Si (max) |
| MIM-2200(1) | Bal. | 1.5-2.5 | 0.5 max | 0.1 max | 1.0 |
| MIM-2700 | Bal. | 6.5-8.5 | 0.5 max | 0.1 max | 1.0 |
| MIM-4605(2) | Bal. | 1.5-2.5 | 0.2-0.5 | 0.4-0.6 | 1.0 |

TABLE II

| Material Designation | Chemical Composition, % - Stainless Steels | | | | | | | | |
|---|---|---|---|---|---|---|---|---|---|
| Code | Fe | Ni | Cr | Mo | C | Cu | Nb + Ta | Mn (max) | Si (max) |
| MIM-316L | Bal. | 10-14 | 16-18 | 2-3 | 0.03 max | — | — | 2.0 | 1.0 |
| MIM-420 | Bal. | — | 12-14 | — | 0.15-0.4 | — | — | 1.0 | 1.0 |
| MIM-430L | Bal. | — | 16-18 | — | 0.05 max | — | — | 1.0 | 1.0 |
| MIM-17-4 PH | Bal. | 3-5 | 15.5-17.5 | — | 0.07 max | 3-5 | 0.15-0.45 | 1.0 | 1.0 |

TABLE III

| Material Designation | Chemical Composition, % - Soft-Magnetic Alloys | | | | | | | |
|---|---|---|---|---|---|---|---|---|
| Code | Fe | Ni | Cr | Co | Si | C (max) | Mn | V |
| MIM-2200 | Bal. | 1.5-2.5 | — | — | 1.0 max | 0.1 | — | — |
| MIM-Fe—3% Si | Bal. | — | — | — | 2.5-3.5 | 0.05 | — | — |
| MIM-Fe50% Ni | Bal. | 49-51 | — | — | 1.0 max | 0.05 | — | — |
| MIM-Fe50% Co | Bal. | — | — | 48-50 | 1.0 max | 0.05 | — | 2.5 max |
| MIM-430L | Bal. | — | 16-18 | — | 1.0 max | 0.05 | 1.0 max | — |

TABLE IV

| Material Designation | Nominal Chemical Composition, % - Controlled-Expansion Alloys | | | | | | | | | | | | |
|---|---|---|---|---|---|---|---|---|---|---|---|---|---|
| | Fe | Ni | Co | Mn max | Si max | C max | Al max | Mg max | Zr max | Ti max | Cu max | Cr max | Mo max |
| MIM-F15 | Bal. | 29 | 17 | 0.50 | 0.20 | 0.04 | 0.10 | 0.10 | 0.10 | 0.10 | 0.20 | 0.20 | 0.20 |

In addition to the specific compositions listed herein, the skill artisan recognizes the elemental composition of common commercial designations used by feedstock manufacturers and processors, e.g., C-0000 Copper and Copper Alloys; CFTG-3806-K Diluted Bronze Bearings; CNZ-1818 Copper and Copper Alloys; CNZP-1816 Copper and Copper Alloys; CT-1000 Copper and Copper Alloys; CT-1000-K Bronze Bearings; CTG-1001-K Bronze Bearings; CTG-1004-K Bronze Bearings; CZ-1000 Copper and Copper Alloys; CZ-2000 Copper and Copper Alloys; CZ-3000 Copper and Copper Alloys; CZP-1002 Copper and Copper Alloys; CZP-2002 Copper and Copper Alloys; CZP-3002 Copper and Copper Alloys; F-0000 Iron and Carbon Steel; F-0000-K Iron and Iron-Carbon Bearings; F-0005 Iron and Carbon Steel; F-0005-K Iron and Iron-Carbon Bearings; F-0008 Iron and Carbon Steel; F-0008-K Iron and Iron-Carbon Bearings; FC-0200 Iron-Copper and Copper Steel; FC-0200-K Iron-Copper Bearings; FC-0205 Iron-Copper and Copper Steel; FC-0205-K Iron-Copper-Carbon Bearings; FC-0208 Iron-Copper and Copper Steel; FC-0208-K Iron-Copper-Carbon Bearings; FC-0505 Iron-Copper and Copper Steel; FC-0508 Iron-Copper and Copper Steel; FC-0508-K Iron-Copper-Carbon Bearings; FC-0808 Iron-Copper and Copper Steel; FC-1000 Iron-Copper and Copper Steel; FC-1000-K Iron-Copper Bearings; FC-2000-K Iron-Copper Bearings; FC-2008-K Iron-Copper-Carbon Bearings; FCTG-3604-K Diluted Bronze Bearings; FD-0200 Diffusion-Alloyed Steel; FD-0205 Diffusion-Alloyed Steel; FD-0208 Diffusion-Alloyed Steel; FD-0400 Diffusion-Alloyed Steel; FD-0405 Diffusion-Alloyed Steel; FD-0408 Diffusion-Alloyed Steel; FF-0000 Soft-Magnetic Alloys; FG-0303-K Iron-Graphite Bearings; FG-0308-K Iron-Graphite Bearings; FL-4005 Prealloyed Steel; FL-4205 Prealloyed Steel; FL-4400 Prealloyed Steel; FL-4405 Prealloyed Steel; FL-4605 Prealloyed Steel; FL-4805 Prealloyed Steel; FL-48105 Prealloyed Steel; FL-4905 Prealloyed Steel; FL-5208 Prealloyed Steel; FL-5305 Prealloyed Steel; FLC-4608 Sinter-Hardened Steel; FLC-4805 Sinter-Hardened Steel; FLC-48108 Sinter-Hardened Steel; FLC-4908 Sinter-Hardened Steel; FLC2-4808 Sinter-Hardened Steel; FLDN2-4908 Diffusion-Alloyed Steel; FLDN4C2-4905 Diffusion-Alloyed Steel; FLN-4205 Hybrid Low-Alloy Steel; FLN-48108 Sinter-Hardened Steel; FLN2-4400 Hybrid Low-Alloy Steel; FLN2-4405 Hybrid Low-Alloy Steel; FLN2-4408 Sinter-Hardened Steel; FLN2C-4005 Hybrid Low-Alloy Steel; FLN4-4400 Hybrid Low-Alloy Steel; FLN4-4405 Hybrid Low-Alloy Steel; FLN4-4408 Sinter Hardened Steel; FLN4C-4005 Hybrid Low-Alloy Steel; FLN6-4405 Hybrid Low-Alloy Steel; FLN6-4408 Sinter-Hardened Steel; FLNC-4405 Hybrid Low-Alloy Steel; FLNC-4408 Sinter-Hardened Steel; FN-0200 Iron-Nickel and Nickel Steel; FN-0205 Iron-Nickel and Nickel Steel; FN-0208 Iron-Nickel and Nickel Steel; FN-0405 Iron-Nickel and Nickel Steel; FN-0408 Iron-Nickel and Nickel Steel; FN-5000 Soft-Magnetic Alloys; FS-0300 Soft-Magnetic Alloys; FX-1000 Copper-Infiltrated Iron and Steel; FX-1005 Copper-Infiltrated Iron and Steel; FX-1008 Copper-Infiltrated Iron and Steel; FX-2000 Copper-Infiltrated Iron and Steel; FX-2005 Copper-Infiltrated Iron and Steel; FX-2008 Copper-Infiltrated Iron and Steel; FY-4500 Soft-Magnetic Alloys; FY-8000 Soft-Magnetic Alloys; P/F-1020 Carbon Steel PF; P/F-1040 Carbon Steel PF; P/F-1060 Carbon Steel PF; P/F-10C40 Copper Steel PF; P/F-10050 Copper Steel PF; P/F-10060 Copper Steel PF; P/F-1140 Carbon Steel PF; P/F-1160 Carbon Steel PF; P/F-11C40 Copper Steel PF; P/F-11050 Copper Steel PF; P/F-11060 Copper Steel PF; P/F-4220 Low-Alloy P/F-42XX Steel PF; P/F-4240 Low-Alloy P/F-42XX Steel PF; P/F-4260 Low-Alloy P/F-42XX Steel PF; P/F-4620 Low-Alloy P/F-46XX Steel PF; P/F-4640 Low-Alloy P/F-46XX Steel PF; P/F-4660 Low-Alloy P/F-46XX Steel PF; P/F-4680 Low-Alloy P/F-46XX Steel PF; SS-303L Stainless Steel—300 Series Alloy; SS-303N1 Stainless Steel—300 Series Alloy; SS-303N2 Stainless Steel—300 Series Alloy; SS-304H Stainless Steel—300 Series Alloy; SS-304L Stainless Steel—300 Series Alloy; SS-304N1 Stainless Steel—300 Series Alloy; SS-304N2 Stainless Steel—300 Series Alloy; SS-316H Stainless Steel—300 Series Alloy; SS-316L Stainless Steel—300 Series Alloy; SS-316N1 Stainless Steel—300 Series Alloy; SS-316N2 Stainless Steel—300 Series Alloy; SS-409L Stainless Steel—400 Series Alloy; SS-409LE Stainless Steel—400 Series Alloy; SS-410 Stainless Steel—400 Series Alloy; SS-410L Stainless Steel—400 Series Alloy; SS-430L Stainless Steel—400 Series Alloy; SS-430N2 Stainless Steel—400 Series Alloy; SS-434L Stainless Steel—400 Series Alloy; SS-434LCb Stainless Steel—400 Series Alloy; and SS-434N2 Stainless Steel—400 Series Alloy.

Parts are molded until they feel that the cavity has been filled. Both mold design factors such as runner and gate size, gate placement, venting and molding parameters set on the molding machine affect the molded part. A helium Pycnometer can determine if there are voids trapped inside the parts. During molding, you have a tool that can be used to measure the percent of theoretical density achieved on the "Green" or molded part. By crushing the measured "green" molded part back to powder, you can now confirm the percent of air (or voids) trapped in the molded part. To measure this, the density of the molded part should be measured in the helium Pycnometer and compared to the theoretical density of the feedstock. Then, take the same molded part that was used in the density test and crush it back to powder. If this granulate shows a density of more than 100% of that of the feedstock, then some of the primary binders have been lost during the molding process. The molding process needs to be corrected because using this process with a degraded feedstock will result in a larger shrinkage and result in a part smaller than that desired. It is vital to be sure that your molded parts are completely filled before continuing the manufacturing process for debinding and sintering. The helium Pycnometer provides this assurance. Primary debinding properly debound parts are extremely important to establish the correct sintering profile. The primary binder must be completely removed before attempting to start to remove the secondary binder as the secondary binder will travel through the pores created by the extraction of the primary binder. Primary debinding techniques depend on the feedstock type used to make the parts. However the feedstock supplier knows the amount of primary binders that have been added and should be removed before proceeding to the next process step. The feedstock supplier provides a minimum "brown density" that must be achieved before the parts can be moved into a furnace for final debinding and sintering. This minimum brown density will take into account that a small amount of the primary binder remnant may be present and could be removed by a suitable hold during secondary debinding and sintering. The sintering profile should be adjusted to remove the remaining small percent of primary binder before the removal of the secondary binder. Most external feedstock manufacturers provide only a weight loss percent that should be obtained to define suitable debinding. Solvent debound parts must be thoroughly dried, before the helium Pycnometer is used to determine the "brown" density so that the remnant solvent in the part does not affect the measured density value. When the feedstock manufacturer gives you the theoretical density of the "brown" or debound part, can validate the percent of debinding that has been achieved. Most Metal Injection Molding (MIM) operations today perform the secondary debinding and sintering in the same operation. Every MIM molder has gates and runners left over from molding their parts. So, you will be able to now re-use your gates and runners with confidence that they will shrink correctly after sintering. If the feedstock producers have given you the actual and theoretical densities of their feedstock, you can easily measure the densities of the gates and runners and compare the results to the values supplied. Once the regrind densities are higher than that required to maintain the part dimensions, the regrinds are no longer reusable.

Feedstock in accordance with the present invention may be prepared by blending the powdered metal with the binder and heating the blend to form a slurry. Uniform dispersion of the powdered metal in the slurry may be achieved by employing high shear mixing. The slurry may then be cooled to ambient temperature and then granulated to provide the feedstock for the metal injection molding.

One embodiment of the injection molded primer insert may include a composition where Ni may be 2.0, 2.25, 2.50, 2.75, 3.0, 3.25, 3.5, 3.75, 4.0, 4.25, 4.50, 4.75, 5.0, 5.25, 5.5, 5.75, 6.0, 6.25, 6.50, 6.75, 7.0, 7.25, 7.5, 7.75, 8.0, 8.25, 8.50, 8.75, 9.0, 9.25, 9.5, 9.75, 10.0, 10.25, 10.50, 10.75, 11.0, 11.25, 11.5, 11.75, 12.0, 12.25, 12.50, 12.75, 13.0, 13.25, 13.5, 13.75, 14.0, 14.25, 14.50, 14.75, 15.0, 15.25, 15.5, 15.75, 16.0, 16.25, 16.50, 16.75, or 17.0%; Cr may be 9.0, 9.25, 9.5, 9.75, 10.0, 10.25, 10.50, 10.75, 11.0, 11.25, 11.5, 11.75, 12.0, 12.25, 12.50, 12.75, 13.0, 13.25, 13.5, 13.75, 14.0, 14.25, 14.50, 14.75, 15.0, 15.25, 15.5, 15.75, 16.0, 16.25, 16.50, 16.75, 17.0, 17.25, 17.5, 17.75, 18.0, 18.25, 18.50, 18.75, 19.0, 19.25, 19.5, 19.75, or 20.0%; Mo may be 0.00, 0.025, 0.050, 0.075, 0.10, 0.125, 0.150, 0.175, 0.20, 0.225, 0.250, 0.275, 0.30, 0.325, 0.350, 0.375, 0.40, 0.425, 0.450, 0.475, 0.50, 0.525, 0.550, 0.575, 0.60, 0.625, 0.650, 0.675, 0.70, 0.725, 0.750, 0.775, 0.80, 0.825, 0.850, 0.875, 0.90, 0.925, 0.950, 1.0, 1.25, 1.5, 1.75, 2.0, 2.25, 2.50, 2.75, 3.0, 3.25, 3.5, 3.75, 4.0, 4.25, 4.50, 4.75, 5.0, 5.25, 5.5, 5.75, 6.0, 6.25, 6.50, 6.75, or 7.0%; C may be 0.00, 0.025, 0.050, 0.075, 0.10, 0.125, 0.150, 0.175, 0.20, 0.225, 0.250, 0.275, 0.30, 0.325, 0.350, 0.375, 0.40, 0.425, 0.450, 0.475, 0.50, 0.525, 0.550, 0.575, 0.60, 0.625, 0.650, 0.675, 0.70, 0.725, 0.750, 0.775, 0.80, 0.825, 0.850, 0.875, 0.90, 0.925, 0.950, or 1.00%; Cu may be 0.00, 0.025, 0.050, 0.075, 0.10, 0.125, 0.150, 0.175, 0.20, 0.225, 0.250, 0.275, 0.30, 0.325, 0.350, 0.375, 0.40, 0.425, 0.450, 0.475, 0.50, 0.525, 0.550, 0.575, 0.60, 0.625, 0.650, 0.675, 0.70, 0.725, 0.750, 0.775, 0.80, 0.825, 0.850, 0.875, 0.90, 0.925, 0.950, 1.0, 1.25, 1.5, 1.75, 2.0, 2.25, 2.50, 2.75, 3.0, 3.25, 3.5, 3.75, 4.0, 4.25, 4.50, 4.75, 5.0, 5.25, 5.5, 5.75, 6.0, 6.25, 6.50, 6.75, 7.0, 7.25, 7.5, 7.75, or 8.0%; Nb+Ta may be 0.00, 0.025, 0.050, 0.075, 0.10, 0.125, 0.150, 0.175, 0.20, 0.225, 0.250, 0.275, 0.30, 0.325, 0.350, 0.375, 0.40, 0.425, 0.450, 0.475, 0.50, 0.525, 0.550, 0.575, 0.60, 0.625, 0.650, 0.675, 0.70, 0.725, 0.750, 0.775, or 0.80%; Mn may be 0.00, 0.025, 0.050, 0.075, 0.10, 0.125, 0.150, 0.175, 0.20, 0.225, 0.250, 0.275, 0.30, 0.325, 0.350, 0.375, 0.40, 0.425, 0.450, 0.475, 0.50, 0.525, 0.550, 0.575, 0.60, 0.625, 0.650, 0.675, 0.70, 0.725, 0.750, 0.775, 0.80, 0.825, 0.850, 0.875, 0.90, 0.925, 0.950, 1.0, 1.25, 1.5, 1.75, 2.0, 2.25, 2.50, 2.75, 3.0, 3.25, 3.5, 3.75, 4.0, 4.25, 4.50, 4.75, 5.0, 5.25, 5.5, 5.75, or 6.0%; Si may be 0.00, 0.025, 0.050, 0.075, 0.10, 0.125, 0.150, 0.175, 0.20, 0.225, 0.250, 0.275, 0.30, 0.325, 0.350, 0.375, 0.40, 0.425, 0.450, 0.475, 0.50, 0.525, 0.550, 0.575, 0.60, 0.625, 0.650, 0.675, 0.70, 0.725, 0.750, 0.775, 0.80, 0.825, 0.850, 0.875, 0.90, 0.925, 0.950, 1.0, 1.25, 1.5, 1.75, 2.0, 2.25, 2.50, 2.75, 3.0, 3.25, 3.5, 3.75, or 4.0%; and the balance Fe. For example, one embodiment of the injection molded primer insert may include any amount in the range of 2-16% Ni; 10-20% Cr; 0-5% Mo; 0-0.6% C; 0-6.0% Cu; 0-0.5% Nb+Ta; 0-4.0% Mn; 0-2.0% Si and the balance Fe. One embodiment of the injection molded primer insert may include any amount in the range of 2-6% Ni; 13.5-19.5% Cr; 0-0.10% C; 1-7.0% Cu; 0.05-0.65% Nb+Ta; 0-3.0% Mn; 0-3.0% Si and the balance Fe. One embodiment of the injection molded primer insert may include any amount in the range of 3-5% Ni; 15.5-17.5% Cr; 0-0.07% C; 3-5.0% Cu; 0.15-0.45% Nb+Ta; 0-1.0% Mn; 0-1.0% Si and the balance Fe. One embodiment of the injection molded primer insert may include any amount in the range of 10-14% Ni; 16-18% Cr; 2-3% Mo; 0-0.03% C; 0-2% Mn; 0-1% Si and the balance Fe. One embodiment of the injection molded primer insert may include any amount in the range of 12-14% Cr; 0.15-0.4% C; 0-1% Mn; 0-1% Si and the balance Fe. One embodiment of the injection molded primer insert may include any amount in the range of 16-18% Cr; 0-0.05% C; 0-1% Mn; 0-1% Si and the balance Fe.

Titanium alloys that may be used in this invention include any alloy or modified alloy known to the skilled artisan including titanium grades 5-38 and more specifically titanium grades 5, 9, 18, 19, 20, 21, 23, 24, 25, 28, 29, 35, 36 or 38. Grades 5, 23, 24, 25, 29, 35, or 36 annealed or aged; Grades 9, 18, 28, or 38 cold-worked and stress-relieved or annealed; Grades 9, 18, 23, 28, or 29 transformed-beta condition; and Grades 19, 20, or 21 solution-treated or solution-treated and aged. Grade 5, also known as Ti6Al4V, Ti-6Al-4V or Ti 6-4, is the most commonly used alloy. It has a chemical composition of 6% aluminum, 4% vanadium, 0.25% (maximum) iron, 0.2% (maximum) oxygen, and the remainder titanium. It is significantly stronger than commercially pure titanium while having the same stiffness and thermal properties (excluding thermal conductivity, which is about 60% lower in Grade 5 Ti than in CP Ti); Grade 6 contains 5% aluminum and 2.5% tin. It is also known as Ti-5Al-2.5Sn. This alloy has good weldability, stability and strength at elevated temperatures; Grade 7 and 7H contains 0.12 to 0.25% palladium. This grade is similar to Grade 2. The small quantity of palladium added gives it enhanced crevice corrosion resistance at low temperatures and high pH; Grade 9 contains 3.0% aluminum and 2.5% vanadium. This grade is a compromise between the ease of welding and manufacturing of the "pure" grades and the high strength of Grade 5; Grade 11 contains 0.12 to 0.25% palladium; Grade 12 contains 0.3% molybdenum and 0.8% nickel; Grades 13, 14, and 15 all contain 0.5% nickel and 0.05% ruthenium; Grade 16 contains 0.04 to 0.08% palladium; Grade 16H contains 0.04 to 0.08% palladium; Grade 17 contains 0.04 to 0.08% palladium; Grade 18 contains 3% aluminum, 2.5% vanadium and 0.04 to 0.08% palladium; Grade 19 contains 3% aluminum, 8% vanadium, 6% chromium, 4% zirconium, and 4% molybdenum; Grade 20 contains 3% aluminum, 8% vanadium, 6% chromium, 4% zirconium, 4% molybdenum and 0.04% to 0.08% palladium; Grade 21 contains 15% molybdenum, 3% aluminum, 2.7% niobium, and 0.25% silicon; Grade 23 contains 6% aluminum, 4% vanadium, 0.13% (maximum) Oxygen; Grade 24 contains 6% aluminum, 4% vanadium and 0.04% to 0.08% palladium. Grade 25 contains 6% aluminum, 4% vanadium and 0.3% to 0.8% nickel and 0.04% to 0.08% palladium; Grades 26, 26H, and 27 all contain 0.08 to 0.14% ruthenium; Grade 28 contains 3% aluminum, 2.5% vanadium and 0.08 to 0.14% ruthenium; Grade 29 contains 6% aluminum, 4% vanadium and 0.08 to 0.14% ruthenium; Grades 30 and 31 contain 0.3% cobalt and 0.05% palladium; Grade 32 contains 5% aluminum, 1% tin, 1% zirconium, 1% vanadium, and 0.8% molybdenum; Grades 33 and 34 contain 0.4% nickel, 0.015% palladium, 0.025% ruthenium, and 0.15% chromium; Grade 35 contains 4.5% aluminum, 2% molybdenum, 1.6% vanadium, 0.5% iron, and 0.3% silicon; Grade 36 contains 45% niobium; Grade 37 contains 1.5% aluminum; and Grade 38 contains 4% aluminum, 2.5% vanadium, and 1.5% iron. Its mechanical properties are very similar to Grade 5, but has good cold workability similar to grade 9. One embodiment includes a Ti6Al4V composition. One embodiment includes a composition having 3-12% aluminum, 2-8% vanadium, 0.1-0.75% iron, 0.1-0.5% oxygen, and the remainder titanium. More specifically, about 6% aluminum, about 4% vanadium, about 0.25% iron, about 0.2% oxygen, and the remainder titanium. For example, one Ti composition may include 10 to 35% Cr, 0.05 to 15% Al, 0.05 to 2% Ti, 0.05 to 2% $Y_2O_5$, with the balance being either Fe, Ni or Co, or an alloy consisting of 20±1.0% Cr, 4.5±0.5% Al, 0.5±0.1% $Y_2O_5$ or $ThO_2$, with the balance being Fe. For example, one Ti composition may include 15.0-23.0% Cr, 0.5-2.0% Si, 0.0-4.0% Mo, 0.0-1.2% Nb, 0.0-3.0% Fe, 0.0-0.5% Ti, 0.0-0.5% Al, 0.0-0.3% Mn, 0.0-0.1% Zr, 0.0-0.035% Ce, 0.005-0.025% Mg, 0.0005-0.005% B, 0.005-0.3% C, 0.0-20.0% Co, balance Ni. Sample Ti-based feedstock component includes 0-45% metal powder; 15-40% binder; 0-10% Polymer (e.g., thermoplastics and thermosets); surfactant 0-3%; lubricant 0-3%; sintering aid 0-1%. Another sample Ti-based feedstock component includes about 62% TiH2 powder as a metal powder; about 29% naphthalene as a binder; about 2.1-2.3% polymer (e.g., EVA/epoxy); about 2.3% SURFONIC N-100° as a Surfactant; lubricant is 1.5% stearic acid as a; about 0.4% silver as a sintering Aid. Examples of metal compounds include metal hydrides, such as TiH2, and intermetallics, such as TiAl and $TiAl_3$. A specific instance of an alloy includes Ti-6Al, 4V, among others. In another embodiment, the metal powder comprises at least approximately 45% of the volume of the feedstock, while in still another, it comprises between approximately 54.6% and 70.0%. In addition, Ti—Al alloys may consists essentially of 32-38% of Al and the balance of Ti and contains 0.005-0.20% of B, and the alloy which essentially consists of the above quantities of Al and Ti and contains, in addition to the above quantity of B, up to 0.2% of C, up to 0.3% of O and/or up to 0.3% of N (provided that 0+N add up to 0.4%) and c) 0.05-3.0% of Ni and/or 0.05-3.0% of Si, and the balance of Ti.

The amount of powdered metal and binder in the feedstock may be selected to optimize moldability while insuring acceptable green densities. In one embodiment, the feedstock used for the metal injection molding portion of the invention may include at least about 40 percent by weight powdered metal, in another about 50 percent by weight powdered metal or more. In one embodiment, the feedstock includes at least about 60 percent by weight powdered metal, preferably about 65 percent by weight or more powdered metal. In yet another embodiment, the feedstock includes at least about 75 percent by weight powdered metal. In yet another embodiment, the feedstock includes at least about 80 percent by weight powdered metal. In yet another embodiment, the feedstock includes at least about 85 percent by weight powdered metal. In yet another embodiment, the feedstock includes at least about 90 percent by weight powdered metal.

The binding agent may be any suitable binding agent that does not destroy or interfere with the powdered metals. The binder may be present in an amount of about 50 percent or less by weight of the feedstock. In one embodiment, the binder is present in an amount ranging from 10 percent to about 50 percent by weight. In another embodiment, the binder is present in an amount of about 25 percent to about 50 percent by weight of the feedstock. In another embodiment, the binder is present in an amount of about 30 percent to about 40 percent by weight of the feedstock. In one embodiment, the binder is an aqueous binder. In another embodiment, the binder is an organic-based binder. Examples of binders include, but are not limited to, thermoplastic resins, waxes, and combinations thereof. Non-limiting examples of thermoplastic resins include polyolefins such as acrylic polyethylene, polypropylene, polystyrene, polyvinyl chloride, polyethylene carbonate, polyethylene glycol, and mixtures thereof. Suitable waxes include, but are not limited to, microcrystalline wax, bee wax, synthetic wax, and combinations thereof.

Examples of suitable powdered metals for use in the feedstock include, but are not limited to: stainless steel including martensitic and austenitic stainless steel, steel alloys, tungsten alloys, soft magnetic alloys such as iron, iron-silicon, electrical steel, iron-nickel (50Ni-50F3), low thermal expansion alloys, or combinations thereof. In one embodiment, the powdered metal is a mixture of stainless steel, brass and tungsten alloy. The stainless steel used in the present invention may be any 1 series carbon steels, 2 series nickel steels, 3 series nickel-chromium steels, 4 series molybdenum steels, series chromium steels, 6 series chromium-vanadium steels, 7 series tungsten steels, 8 series nickel-chromium-molybdenum steels, or 9 series silicon-manganese steels, e.g., 102, 174, 201, 202, 300, 302, 303, 304, 308, 309, 316, 316L, 316Ti, 321, 405, 408, 409, 410, 416, 420, 430, 439, 440, 446 or 601-665 grade stainless steel.

As known to those of ordinary skill in the art, stainless steel is an alloy of iron and at least one other component that imparts corrosion resistance. As such, in one embodiment, the stainless steel is an alloy of iron and at least one of chromium, nickel, silicon, molybdenum, or mixtures thereof. Examples of such alloys include, but are not limited to, an alloy containing about 1.5 to about 2.5 percent nickel, no more than about 0.5 percent molybdenum, no more than about 0.15 percent carbon, and the balance iron with a density ranging from about 7 g/cm$^3$ to about 8 g/cm$^3$; an alloy containing about 6 to about 8 percent nickel, no more than about 0.5 percent molybdenum, no more than about 0.15 percent carbon, and the balance iron with a density ranging from about 7 g/cm$^3$ to about 8 g/cm$^3$; an alloy containing about 0.5 to about 1 percent chromium, about 0.5 percent to about 1 percent nickel, no more than about 0.5 percent molybdenum, no more than about 0.2 percent carbon, and the balance iron with a density ranging from about 7 g/cm$^3$ to about 8 g/cm$^3$; an alloy containing about 2 to about 3 percent nickel, no more than about 0.5 percent molybdenum, about 0.3 to about 0.6 percent carbon, and the balance iron with a density ranging from about 7 g/cm$^3$ to about 8 g/cm$^3$; an alloy containing about 6 to about 8 percent nickel, no more than about 0.5 percent molybdenum, about 0.2 to about 0.5 percent carbon, and the balance iron with a density ranging from about 7 g/cm$^3$ to about 8 g/cm$^3$; an alloy containing about 1 to about 1.6 percent chromium, about 0.5 percent or less nickel, no more than about 0.5 percent molybdenum, about 0.9 to about 1.2 percent carbon, and the balance iron with a density ranging from about 7 g/cm$^3$ to about 8 g/cm$^3$; and combinations thereof.

Suitable tungsten alloys include an alloy containing about 2.5 to about 3.5 percent nickel, about 0.5 percent to about 2.5 percent copper or iron, and the balance tungsten with a density ranging from about 17.5 g/cm$^3$ to about 18.5 g/cm$^3$; about 3 to about 4 percent nickel, about 94 percent tungsten, and the balance copper or iron with a density ranging from about 17.5 g/cm$^3$ to about 18.5 g/cm$^3$; and mixtures thereof.

In addition, the binders may contain additives such as antioxidants, coupling agents, surfactants, elasticizing agents, dispersants, and lubricants as disclosed in U.S. Pat. No. 5,950,063, which is hereby incorporated by reference in its entirety. Suitable examples of antioxidants include, but are not limited to thermal stabilizers, metal deactivators, or combinations thereof. In one embodiment, the binder includes about 0.1 to about 2.5 percent by weight of the binder of an antioxidant. Coupling agents may include but are not limited to titanate, aluminate, silane, or combinations thereof. Typical levels range between 0.5 and 15% by weight of the binder.

The polymeric and composite casing components may be injection molded.

Polymeric materials for the bullet-end and middle body components must have propellant compatibility and resistance to gun cleaning solvents and grease, as well as resistance to chemical, biological and radiological agents. The polymeric materials must have a temperature resistance higher than the cook-off temperature of the propellant, typically about 320° F. The polymeric materials must have elongation-to-break values that to resist deformation under interior ballistic pressure as high as 60,000 psi in all environments (temperatures from about −65 to about 320° F. and humidity from 0 to 100% relative humidity). According to one embodiment, the middle body component is either molded onto or snap-fit to the casing head-end component after which the bullet-end component is snap-fit or interference fit to the middle body component. The components may be formed from high-strength polymer, composite or ceramic.

Examples of suitable high strength polymers include composite polymer material including a tungsten metal powder, nylon 6/6, nylon 6, and glass fibers; and a specific gravity in a range of 3-10. The tungsten metal powder may be 50%-96% of a weight of the bullet body. The polymer material also includes about 0.5-15%, preferably about 1-12%, and most preferably about 2-9% by weight, of nylon 6/6, about 0.5-15%, preferably about 1-12%, and most preferably about 2-9% by weight, of nylon 6, and about 0.5-15%, preferably about 1-12%, and most preferably about 2-9% by weight, of glass fibers. It is most suitable that each of these ingredients be included in amounts less than 10% by weight. The cartridge casing body may be made of a modified ZYTEL® resin, available from E.I. DuPont De Nemours Co., a modified 612 nylon resin, modified to increase elastic response.

Examples of suitable polymers include polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, or urethane hybrids. Examples of suitable polymers also include aliphatic or aromatic polyamide, polyeitherimide, polysulfone, polyphenylsulfone, poly-phenylene oxide, liquid crystalline polymer and polyketone. Examples of suitable composites include polymers such as polyphenylsulfone reinforced with between about 30 and about 70 weight percent, and preferably up to about 65 weight percent of one or more reinforcing materials selected from glass fiber, ceramic fiber, carbon fiber, mineral fillers, organo nanoclay, or carbon nanotube. Preferred reinforcing materials, such as chopped surface-treated E-glass fibers provide flow characteristics at the above-described loadings comparable to unfilled polymers to provide a desirable combination of strength and flow characteristics that permit the molding of head-end components. Composite components can be formed by machining or injection molding. Finally, the cartridge case must retain sufficient joint strength at cook-off temperatures.

More specifically, polymers suitable for molding of the projectile-end component have one or more of the following properties: Yield or tensile strength at −65° F.>10,000 psi Elongation-to-break at −65° F.>15% Yield or tensile strength at 73° F.>8,000 psi Elongation-to-break at 73° F.>50% Yield or tensile strength at 320° F.>4,000 psi Elongation-to-break at 320° F.>80%. Polymers suitable for molding of the middle-body component have one or more of the following properties: Yield or tensile strength at −65° F.>10,000 psi Yield or tensile strength at 73° F.>8,000 psi Yield or tensile strength at 320° F.>4,000 psi.

Commercially available polymers suitable for use in the present invention thus include polyphenylsulfones; copolymers of polyphenylsulfones with polyether-sulfones or polysulfones; copolymers and blends of polyphenylsulfones with polysiloxanes;

poly(etherimide-siloxane); copolymers and blends of polyetherimides and polysiloxanes, and blends of polyetherimides and poly(etherimide-siloxane) copolymers; and the like. Particularly preferred are polyphenylsulfones and their copolymers with poly-sulfones or polysiloxane that have high tensile strength and elongation-to-break to sustain the deformation under high interior ballistic pressure. Such polymers are commercially available, for example, RADEL® R5800 polyphenylesulfone from Solvay Advanced Polymers. The polymer can be formulated with up to about 10 wt % of one or more additives selected from internal mold release agents, heat stabilizers, anti-static agents, colorants, impact modifiers and UV stabilizers.

The polymers of the present invention can also be used for conventional two-piece metal-plastic hybrid cartridge case designs and conventional shotgun shell designs.

One example of such a design is an ammunition cartridge with a one-piece substantially cylindrical polymeric cartridge casing body with an open projectile-end and an end opposing the projectile-end with a male or female coupling element; and a cylindrical metal cartridge casing head-end component with an essentially closed base end with a primer hole opposite an open end having a coupling element that is a mate for the coupling element on the opposing end of the polymeric cartridge casing body joining the open end of the head-end component to the opposing end of the polymeric cartridge casing body. The high polymer ductility permits the casing to resist breakage.

One embodiment includes a 2 cavity prototype mold having an upper portion and a base portion for a 5.56 case having a metal insert over-molded with a Nylon 6 (polymer) based material. In this embodiment the polymer in the base includes a lip or flange to extract the case from the weapon. One 2-cavity prototype mold to produce the upper portion of the 5.56 case can be made using a stripper plate tool using an Osco hot spur and two subgates per cavity. Another embodiment includes a subsonic version, the difference from the standard and the subsonic version is the walls are thicker thus requiring less powder. This will decrease the velocity of the bullet thus creating a subsonic round.

The extracting inserts is used to give the polymer case a tough enough ridge and groove for the weapons extractor to grab and pull the case out the chamber of the gun. The extracting insert is made of 17-4 stainless steel that is hardened to 42-45rc. The insert may be made of aluminum, brass, cooper, steel or even an engineered resin with enough tensile strength.

The insert is over molded in an injection molded process using a nano clay particle filled Nylon material. The inserts can be machined or stamped. In addition, an engineered resin able to withstand the demand on the insert allows injection molded and/or even transfer molded.

One of ordinary skill in the art will know that many propellant types and weights can be used to prepare workable ammunition and that such loads may be determined by a careful trial including initial low quantity loading of a given propellant and the well known stepwise increasing of a given propellant loading until a maximum acceptable load is achieved. Extreme care and caution is advised in evaluating new loads. The propellants available have various burn rates and must be carefully chosen so that a safe load is devised.

The components may be made of polymeric compositions, metals, ceramics, alloys, or combinations and mixtures thereof. In addition, the components may be mixed and matched with one or more components being made of different materials. For example, the middle body component (not shown) may be polymeric; the bullet-end component 18 may be polymeric; and a substantially cylindrical insert (not shown) may be metal. Similarly, the middle body component (not shown) may be polymeric; the bullet-end component 18 may be metal; and a substantially cylindrical insert (not shown) may be an alloy. The middle body component (not shown) may be polymeric; the bullet-end component 18 may be an alloy;

and a substantially cylindrical insert (not shown) may be an alloy. The middle body component (not shown); the bullet-end component 18; and/or the substantially cylindrical insert may be made of a metal that is formed by a metal injection molding process.

The molded substantially cylindrical insert 32 is then bound to the middle body component 28. In the metal injection molding process of making the substantially cylindrical insert 32 a mold is made in the shape of the substantially cylindrical insert 32 including the desired profile of the primer recess (not shown). The substantially cylindrical insert 32 includes a substantially cylindrical coupling element 30 extending from a bottom surface 34 that is opposite a top surface (not shown). Located in the top surface (not shown) is a primer recess (not shown) that extends toward the bottom surface 34. A primer flash hole (not shown). is located in the substantially cylindrical insert 32 and extends through the bottom surface 34 into the powder chamber 14. The coupling end (not shown) extends through the primer flash hole (not shown) to form an aperture coating (not shown) while retaining a passage from the top surface (not shown) through the bottom surface (not shown) and into the powder chamber 14 to provides support and protection about the primer flash hole (not shown). When contacted the coupling end (not shown) interlocks with the substantially cylindrical coupling element 30, through the coupling element 30 that extends with a taper to a smaller diameter at the tip (not shown) to form a physical interlock between substantially cylindrical insert 32 and middle body component 28.

For example, the metal injection molding process, which generally involves mixing fine metal powders with binders to form a feedstock that is injection molded into a closed mold, may be used to form a substantially cylindrical insert. After ejection from the mold, the binders are chemically or thermally removed from the substantially cylindrical insert so that the part can be sintered to high density. During the sintering process, the individual metal particles metallurgically bond together as material diffusion occurs to remove most of the porosity left by the removal of the binder.

The raw materials for metal injection molding are metal powders and a thermoplastic binder. There are at least two Binders included in the blend, a primary binder and a secondary binder. This blended powder mix is worked into the plasticized binder at elevated temperature in a kneader or shear roll extruder. The intermediate product is the so-called feedstock. It is usually granulated with granule sizes of several millimeters. In metal injection molding, only the binders are heated up, and that is how the metal is carried into the mold cavity.

The two piece primer insert includes an individual upper primer insert portion and lower primer insert portion formed in various methods. For example, the individual upper primer insert portion may be formed by metal injection molding, polymer injection molding, stamping, milling, molding, machining, punching, fine blanking, smelting, or any other method. The lower primer insert portion may be formed by metal injection molding, polymer injection molding, stamping, milling, molding, machining, punching, fine blanking, smelting, or any other method that will form insert portions.

The individual upper primer insert portion may be formed from any material, any metal, any alloy, any plastic, any polymer or any composition known to the skilled artisan or listed herein. The individual lower primer insert portion may be formed from any material, any metal, any alloy, any plastic, any polymer or any composition known to the skilled artisan or listed herein.

The individual upper primer insert portion may be formed from entirely or in part from a copolymer of polylactic acid and polycarbonate, the concentration polylactic acid may be between 5-97% and the polycarbonate may be between 5-97%. The 5-97% is meant to be inclusive and include all percentages between 5 and 97 including fractional increments thereof, e.g., 5, 5.25, 5.5, 6, 6.75, 7, 7.4, 8, 8.9, 9, 10 15, 20, 25, 30, 35, 40, 45, 50, 55, 60, 65, 70, 75, 80, 85, 90, 95, or 97. In addition, the copolymer may include other polymers, additives, fibers, nanoclay, metals etc. When other polymers are present the combined percentage of polylactic acid and polycarbonate may be 5, 6, 7, 8, 9, 10 15, 20, 25, 30, 35, 40, 45, 50, 55, 60, 65, 70, 75, 80, 85, 90, 95, or 100.

The description of the preferred embodiments should be taken as illustrating, rather than as limiting, the present invention as defined by the claims. As will be readily appreciated, numerous combinations of the features set forth above can be utilized without departing from the present invention as set forth in the claims. Such variations are not regarded as a departure from the spirit and scope of the invention, and all such modifications are intended to be included within the scope of the following claims.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein.

Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A method of making a polymer ammunition cartridge having a two-piece primer insert comprising the steps of:

providing a two piece primer insert comprising:

an upper primer insert portion connected to a lower primer insert portion, wherein the upper primer insert portion comprises:

an upper primer insert top surface, an upper primer insert bottom surface opposite the upper primer insert top surface, an upper primer insert aperture through the upper primer insert top surface the upper primer insert bottom surface, a primer flash aperture groove positioned in the upper primer insert bottom surface around the upper primer insert aperture, the primer flash aperture groove configured to receive a polymer overmolding through the upper primer insert aperture, and a substantially cylindrical coupling element extending away from the upper primer insert top surface, wherein the lower primer insert portion comprises:

a lower primer insert bottom surface opposite a lower primer insert top surface, a primer recess in the lower primer insert top surface that extends toward the lower primer insert bottom surface and the primer recess adapted to fit a primer, a lower flash hole aperture through the lower primer insert bottom surface, wherein the lower flash hole aperture is at least the same size as the primer flash aperture groove to form a flash hole groove in the primer recess;

providing a first polymer composition for molding a polymer ammunition cartridge;

molding from the first polymer composition a substantially cylindrical polymeric middle body having the two piece primer insert at a first end and a substantially cylindrical polymeric coupling element at a second end, wherein the first polymer composition extends over an outer surface of the two-piece primer insert and extends over an interior surface of the substantially cylindrical coupling element into the primer flash aperture groove, wherein the first polymer composition extends from the substantially cylindrical polymeric coupling element into the primer flash aperture groove;

forming a substantially cylindrical polymeric bullet-end component from a second polymer composition comprising a bullet aperture opposite a polymeric bullet-end coupling that mates to the substantially cylindrical coupling element; and coupling the substantially cylindrical coupling element to the polymeric bullet-end coupling to form a propellant chamber that extends from the primer flash aperture groove aperture to the bullet aperture;

inserting a primer into the primer recess, wherein the primer is in operable communication with the propellant chamber through the primer flash aperture groove;

at least partially filling the propellant chamber with a propellant; and frictionally fitting a projectile in the bullet-end aperture, wherein the propellant chamber is enclosed at one end by the primer and the projectile at the other end.

2. The method of claim 1, wherein an insert joint between the upper primer insert portion and lower primer insert portion is threaded, riveted, locked, friction fitted, coined, snap fitted, chemical bonded, chemical welded, soldered, smelted, sintered, adhesive bonded, laser welded, ultrasonic welded, friction spot welded, or friction stir welded.

3. The method of claim 1, wherein the upper primer insert portion, the lower primer insert portion or both are formed independently by metal injection molding, polymer injection molding, stamping, milling, molding, machining, punching, fine blanking, smelting, or any other method that will form insert portions that may be joined together to form the two-piece primer insert.

4. The method of claim 1, wherein the upper primer insert portion, the lower primer insert portion or both independently comprise a polymer, a metal, an alloy, or a ceramic alloy.

5. The method of claim 4, wherein the upper primer insert portion and the lower primer insert portion comprise the same material or different materials.

6. The method of claim 1, wherein the upper primer insert portion comprises a polymer, a metal, an alloy, or a ceramic alloy and the lower primer insert portion comprises a different polymer, metal, alloy, or ceramic alloy.

7. The method of claim 1, wherein the upper primer insert portion and the lower primer insert portion comprise steel, nickel, chromium, copper, carbon, iron, stainless steel or brass.

8. The method of claim 1, wherein the first polymer composition, the second polymer composition or both independently comprise a nylon polymer.

9. The method of claim 1, wherein the first polymer composition, the second polymer composition or both independently comprise between about 10 and about 70 wt % glass fiber fillers, mineral fillers, or mixtures thereof.

10. The method of claim 1, wherein the first polymer composition, the second polymer composition or both independently comprise polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers.

11. The method of claim 1, wherein the bullet aperture comprises one or more cannelures formed on an inner circumferential surface of the bullet aperture.

12. The method of claim 1, wherein the bullet aperture accepts a .221, .223, .243, .25-06, .264, .270, .300, .308, .338, .30-30, .30-06, .45-70 or .50-90, 50 caliber, 45 caliber, 380 caliber or 38 caliber, 5.56 mm, 6 mm, 7 mm, 7.62 mm, 8 mm, 9 mm, 10 mm, 12.7 mm, 14.5 mm, 14.7 mm, 20 mm, 25 mm, 30 mm, 40 mm, 57 mm, 60 mm, 75 mm, 76 mm, 81 mm, 90 mm, 100 mm, 105 mm, 106 mm, 115 mm, 120 mm, 122 mm, 125 mm, 130 mm, 152 mm, 155 mm, 165 mm, 175 mm, 203 mm or 460 mm, 4.2 inch or 8 inch projectile.

13. The method of claim 1, wherein the projectile has a frustoconical shaped nose.

14. The method of claim 1, further comprising the step of positioning a diffuser in the primer recess under the primer.

* * * * *